US009844696B2

(12) United States Patent
Anderson et al.

(10) Patent No.: US 9,844,696 B2
(45) Date of Patent: Dec. 19, 2017

(54) PORTABLE EXERCISE DEVICE

(71) Applicants: Kristin J Anderson, Los Angeles, CA (US); Brian Abercrombie, Los Angeles, CA (US)

(72) Inventors: Kristin J Anderson, Los Angeles, CA (US); Brian Abercrombie, Los Angeles, CA (US)

(73) Assignee: ENGINE FITNESS, West Hollywood, CA (US)

( * ) Notice: Subject to any disclaimer, the term of this patent is extended or adjusted under 35 U.S.C. 154(b) by 0 days.

(21) Appl. No.: 14/756,778

(22) Filed: Oct. 13, 2015

(65) Prior Publication Data

US 2017/0266486 A1 Sep. 21, 2017

(51) Int. Cl.
*A63B 21/00* (2006.01)
*A63B 21/04* (2006.01)
(Continued)

(52) U.S. Cl.
CPC ..... *A63B 21/4049* (2015.10); *A63B 21/0004* (2013.01); *A63B 21/00061* (2013.01);
(Continued)

(58) Field of Classification Search
CPC ..... A63B 19/00; A63B 19/02; A63B 19/04; A63B 21/0004; A63B 21/00058; A63B 21/00061; A63B 21/00065; A63B 21/00069; A63B 21/00076; A63B 21/00178; A63B 21/00181; A63B 21/00185; A63B 21/002; A63B 21/0023; A63B 21/02; A63B 21/04; A63B 21/0407;
(Continued)

(56) References Cited

U.S. PATENT DOCUMENTS 1,997,139 A * 4/1935 Gardener ..... A63B 22/20 36/114
2,676,802 A * 4/1954 O'Brien ..... A63B 21/0724 446/431
(Continued)

OTHER PUBLICATIONS

Orbit Wheel, https://www.orbit-wheel.com/product/orbit-wheel-orbit-wheels-for-sale-green-and-grey/, retrieved Jun. 29, 2017.
(Continued)

*Primary Examiner* — Loan H Thanh
*Assistant Examiner* — Gary D Urbiel Goldner
(74) *Attorney, Agent, or Firm* — Brian Billett

(57) ABSTRACT

A portable exercise device allowing a user to perform Pilates type exercises without using traditional, cumbersome equipment. The device uses a pair of wheel assemblies respectively attached to opposing ends of a central shaft. A shaft height can be adjusted from a center of each wheel to a lower point closer to a ground surface. Adjustable cam lockable hand/foot plates are attached to the shaft allowing the user to attach his or her feet to the shaft. Each hand/foot plate includes a rotational plate that allows the hand/foot plate to be positioned at various angles in relation to the shaft. Resistance bands are attached on one side to the shaft and on the opposite side to a resistance source. The resistance source can be the user's own hands or feet, or a retaining strap attached to a lower portion of a door or wall.

13 Claims, 25 Drawing Sheets

(51) Int. Cl.
*A63B 21/055* (2006.01)
*A63B 21/16* (2006.01)
*A63B 21/22* (2006.01)
*A63B 23/02* (2006.01)

(52) U.S. Cl.
CPC .... *A63B 21/00069* (2013.01); *A63B 21/0442* (2013.01); *A63B 21/0555* (2013.01); *A63B 21/0557* (2013.01); *A63B 21/1645* (2013.01); *A63B 21/22* (2013.01); *A63B 21/4015* (2015.10); *A63B 21/4034* (2015.10); *A63B 21/4035* (2015.10); *A63B 23/02* (2013.01); *A63B 2210/50* (2013.01); *A63B 2225/093* (2013.01)

(58) Field of Classification Search
CPC ..... A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/22; A63B 21/225; A63B 21/227; A63B 21/4015; A63B 21/4023; A63B 21/4025; A63B 21/4027; A63B 21/4033; A63B 21/4034; A63B 21/4035; A63B 21/4039; A63B 21/4043; A63B 21/4045; A63B 21/4049; A63B 22/0076; A63B 22/0087; A63B 22/0089; A63B 22/20; A63B 22/201; A63B 22/203; A63B 2022/0079; A63B 23/02; A63B 23/0205; A63B 23/0211; A63B 23/0216; A63B 23/0222; A63B 23/035; A63B 23/03516; A63B 23/03525; A63B 23/0355; A63B 23/03575; A63B 23/04; A63B 23/0405; A63B 23/047; A63B 23/0482; A63B 23/0494; A63B 23/08; A63B 23/085; A63B 23/10; A63B 23/12; A63B 23/1209; A63B 23/1227; A63B 23/1236; A63B 23/1245; A63B 23/1281; A63B 26/00; A63B 26/003; A63B 69/0057; A63B 69/0059; A63B 69/06; A63B 2069/0062; A63B 2069/062; A63B 71/0054; A63B 2071/0063; A63B 2071/0072; A63B 2208/02; A63B 2208/0204; A63B 2208/0209; A63B 2208/0214; A63B 2208/0219; A63B 2208/0228; A63B 2208/0238; A63B 2208/0242; A63B 2208/0247; A63B 2208/0295; A63B 2210/50; A63B 2225/09; A63B 2225/093
USPC ..... 280/205, 208, 229
See application file for complete search history.

(56) References Cited

U.S. PATENT DOCUMENTS

| | | | | | |
|---|---|---|---|---|---|
| 4,369,968 | A * | 1/1983 | Price | A63B 21/0601 | 482/106 |
| 4,775,147 | A * | 10/1988 | Bold, Jr. | A63B 21/227 | 482/108 |
| 4,900,017 | A * | 2/1990 | Bold, Jr. | A63B 21/227 | 482/108 |
| 5,004,229 | A * | 4/1991 | Lind | A63B 22/20 | 482/132 |
| 5,176,595 | A * | 1/1993 | Lind | A63B 22/20 | 482/148 |
| 5,222,930 | A * | 6/1993 | Bold, Jr. | A63B 21/227 | 482/108 |
| 5,447,483 | A * | 9/1995 | Liang | A63B 21/151 | 280/218 |
| 6,053,853 | A * | 4/2000 | Hinds | A63B 22/20 | 280/205 |
| 6,328,680 | B1 * | 12/2001 | Shifferaw | A63B 21/0618 | 482/127 |
| 6,416,136 | B1 | 7/2002 | Smith | | |
| 6,575,883 | B1 * | 6/2003 | Hinds | A63B 21/0004 | 482/125 |
| 6,979,285 | B2 * | 12/2005 | Lovison | A63B 21/0004 | 482/132 |
| 7,011,610 | B2 * | 3/2006 | Wawrzyniak | A63B 21/0726 | 482/104 |
| 7,104,937 | B2 | 9/2006 | Arbuckle et al. | | |
| 7,407,465 | B1 * | 8/2008 | Alzamora, Sr. | A63B 22/20 | 280/205 |
| 7,481,441 | B2 | 1/2009 | Kirkham | | |
| 7,762,936 | B2 | 7/2010 | Conley et al. | | |
| 8,029,425 | B2 | 10/2011 | Bronston et al. | | |
| 9,155,930 | B2 * | 10/2015 | Adkins | A63B 21/075 | |
| 9,180,335 | B1 * | 11/2015 | Wu | A63B 23/02 | |
| 9,192,802 | B2 | 11/2015 | Pearce | | |
| 9,370,681 | B2 | 6/2016 | Chang | | |
| 2002/0187883 | A1 * | 12/2002 | Lovison | A63B 21/154 | 482/92 |
| 2003/0096680 | A1 * | 5/2003 | Nethery | A63B 21/0004 | 482/92 |
| 2012/0225758 | A1 * | 9/2012 | Shaw | A63B 21/0004 | 482/110 |
| 2013/0012369 | A1 * | 1/2013 | Prest | A63B 22/20 | 482/132 |
| 2013/0310231 | A1 | 11/2013 | Pearce | | |
| 2015/0297932 | A1 | 10/2015 | Wehrell | | |

OTHER PUBLICATIONS

The Pilates Wheel, http://www.thepilateswheel.com, retrieved Aug. 14, 2017.

* cited by examiner

PORTABLE EXERCISE DEVICE

FIELD OF THE INVENTION

This invention relates generally to the field of exercise devices and more specifically to portable exercise devices to facilitate performing Pilates type exercises and other muscle strengthening exercises.

BACKGROUND

Portable exercise devices are well known. They have evolved from simple hand weights to elaborate electro-mechanical devices which offer various types of resistance elements that the user engages to introduce resistance to various muscle groups.

One category of portable exercise devices involves the use of one or more wheels attached to a shaft where the user engages his or her hands or feet with the shaft and proceeds to roll the wheels back and forth to engage specific muscle groups. For example, in U.S. Pat. No. 4,595,197 by D Hagstrom et al describes a two wheeled exercise device where the user either advances the wheels with his hands or feet to cause various muscles to be worked. U.S. Pat. No. 6,017,296 by J. Tang describes an exercise wheel assembly that has an internal resistance band to cause the wheel to be harder to push along a floor as distance increases.

Another category of exercise devices has been developed to help the user perform Pilates type exercises. Pilates is a body conditioning routine that helps build flexibility, muscle strength, and endurance in the legs, abdominals, arms, hips, and back. It puts emphasis on spinal and pelvic alignment, breathing, and developing a strong core or center, and improving coordination and balance. Pilates' system allows for different exercises to be modified in range of difficulty from beginning to advanced. Intensity can be increased over time as the body conditions and adapts to the exercise. Various pieces of equipment have been designed and marketed to facilitate Pilates exercise; however, they tend to be expensive, large and heavy assemblies that are usually found in dedicated Pilates exercise studios. The bulky equipment restricts the possibility for a person to practice Pilates exercises in the privacy of their own home unless they are willing to invest in commercial grade equipment and have the available square footage in their home to accommodate the large size of the standard equipment.

SUMMARY

It is important to note that even though the present invention is ideal for doing many Pilates type exercises, it is also ideal for doing a wide variety of other muscle strengthening exercises that might not be considered to be Pilates exercises The primary object of the invention is to provide a portable exercise device that allows a person to do Pilates type exercises without the need for a large cumbersome apparatus.

Another object of the invention is to provide a portable exercise device that can provide either resistance or assistance to the user's muscles as needed during an exercise routine.

Another object of the invention is to provide a portable exercise device that allows the user to easily and quickly adjust the height of the foot or hand placement with respect to the ground.

A further object of the invention is to provide a portable exercise device that can be easily and quickly disassembled for compact storage.

Other objects and advantages of the present invention will become apparent from the following descriptions, taken in connection with the accompanying drawings, wherein, by way of illustration and example, an embodiment of the present invention is disclosed.

An embodiment disclosed is a portable exercise device comprising: a pair of wheel assemblies, a pair of wheel retaining outer hubs, a shaft, a pair of shaft end plates, a pair of hand grips, a pair of strap retaining rings, a pair of hand/foot retaining plate assemblies, said shaft including threaded portions extending from each end of said shaft, said shaft end plates fixedly attached to each end of said shaft, said wheel assemblies each having wheels approximately fourteen inches in diameter and having an inner stationary portion, a middle bearing portion and an outer rotatable rim and tire portion, said inner stationary wheel portion of said wheel including a slot starting at the center of said wheel and ending approximately four inches from said center of said wheel, said inner stationary wheel portion of said wheel also including apertures for removably retaining posts extending from said shaft end plates, said stationary wheel portion trapped and supported between said shaft end plate and said outer hub, said hand/foot assembly including a shaft retaining collar, a first support plate fixedly attached to said shaft retaining collar, a second rotatable plate positioned above said first plate and a spring biased locking pin assembly to selectively lock said second rotatable plate to said first plate at a desired angle, said hand/foot assembly also including an adjustable foot or hand retaining strap, said hand grips attached to either end of said shaft, and said retaining rings attached to either end of said shaft in close proximity to said hand grips.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION

Detailed descriptions of the various embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
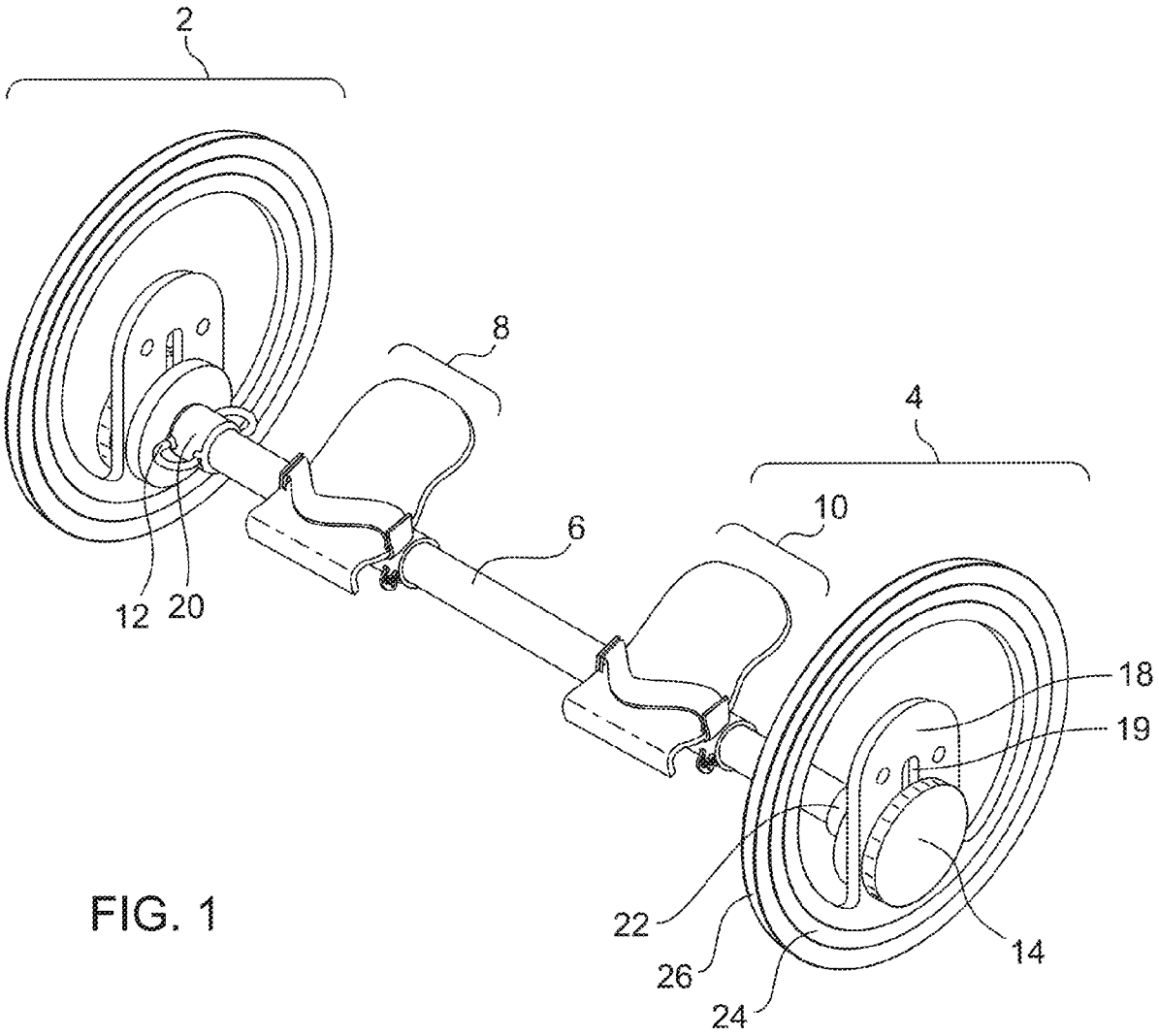
FIG. 1 is a perspective view of an embodiment with the shaft in the low position.
Figure 2:
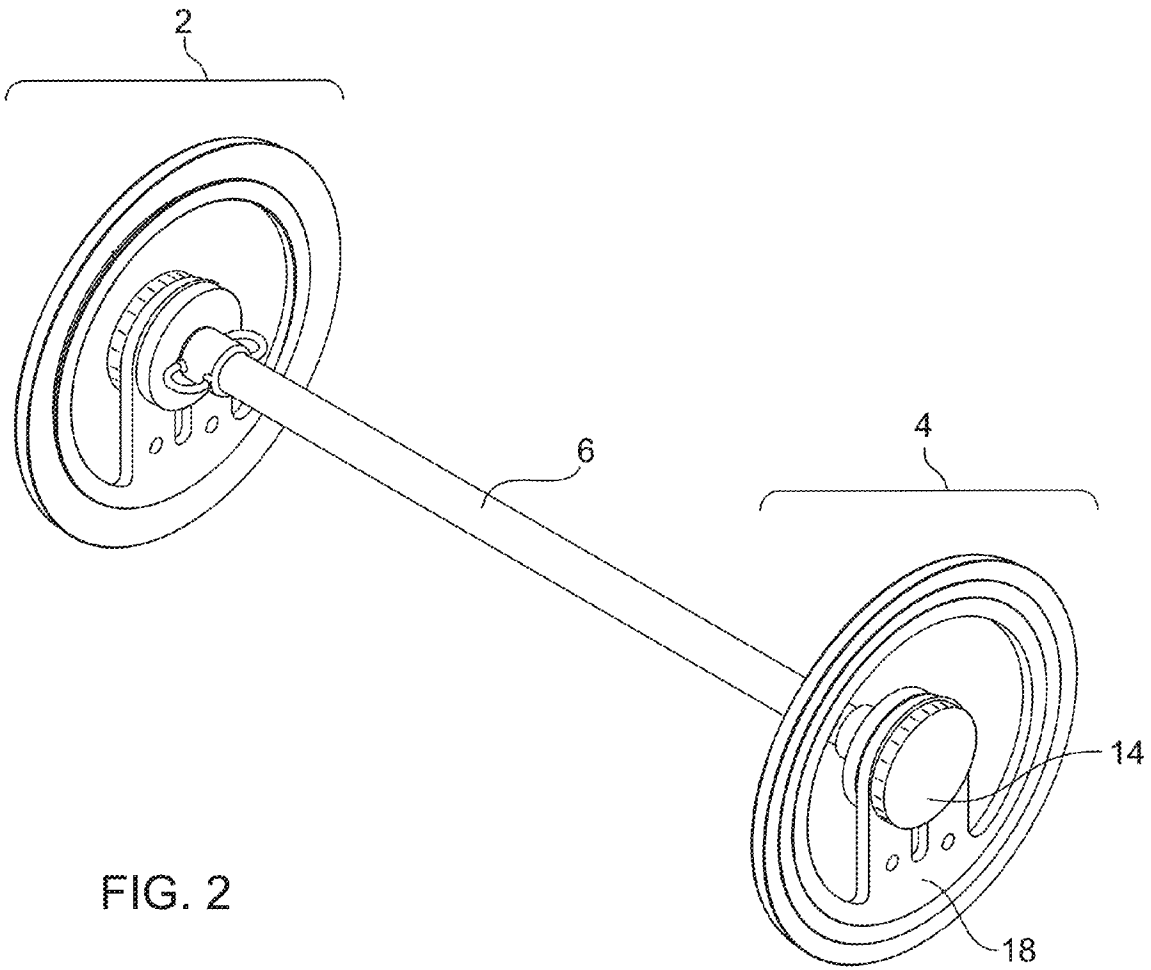
FIG. 2 is a perspective view of an embodiment without the hand/foot plates with the shaft in the center position.

Referring now to FIG. 1 we see a perspective view of an embodiment apparatus 100. In this view the shaft 6 is in the low position. Wheel assemblies 2, 4 are attached to each end of the shaft by threaded posts 90 as shown in FIG. 6. Wheel assemblies 2, 4 are approximately fourteen inches in diameter and include a stationary inner member 18 and a rotatable outer ring 24 that is supported by a ball bearing 60 inner ring 58 as shown in the plan view of the wheel assembly in FIG. 5. The outer ring 24 is capped by a rubber tire 26. The configuration shown allows the user to choose whether to place the shaft 6 in the center position as shown in FIG. 2, or the low position as shown in FIG. 1. The low position is helpful when doing certain exercises such as the one shown in FIG. 13. As may be readily understood from the drawings, the word "stationary" as used herein means that the inner member 18 may be generally rotationally stationary during operation with respect to the floor, while rotating with respect to the outer ring 24 of the wheel assembly.

Figure 3:
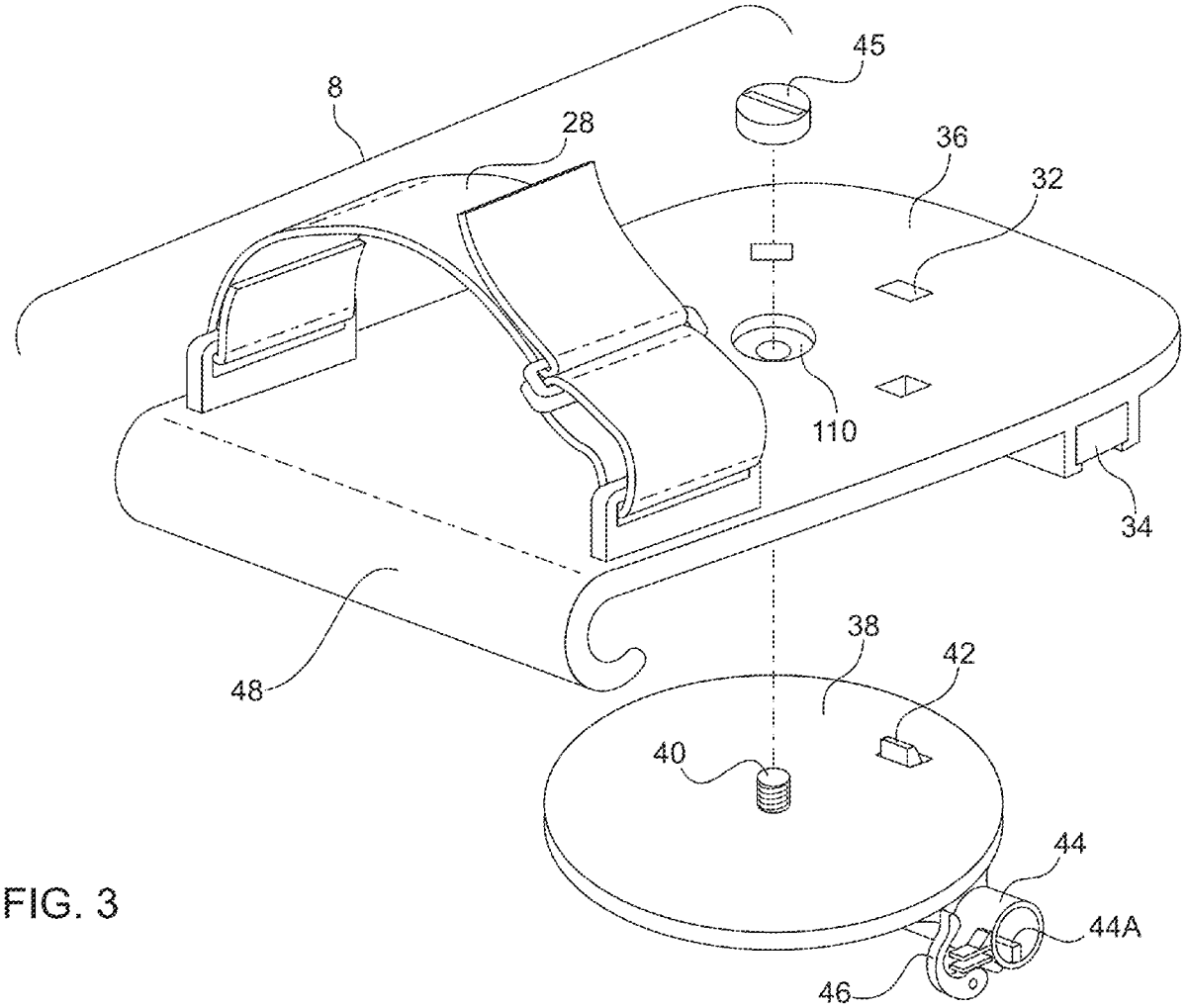
FIG. 3 is an exploded view of the hand/foot plate assembly.
Figure 23:
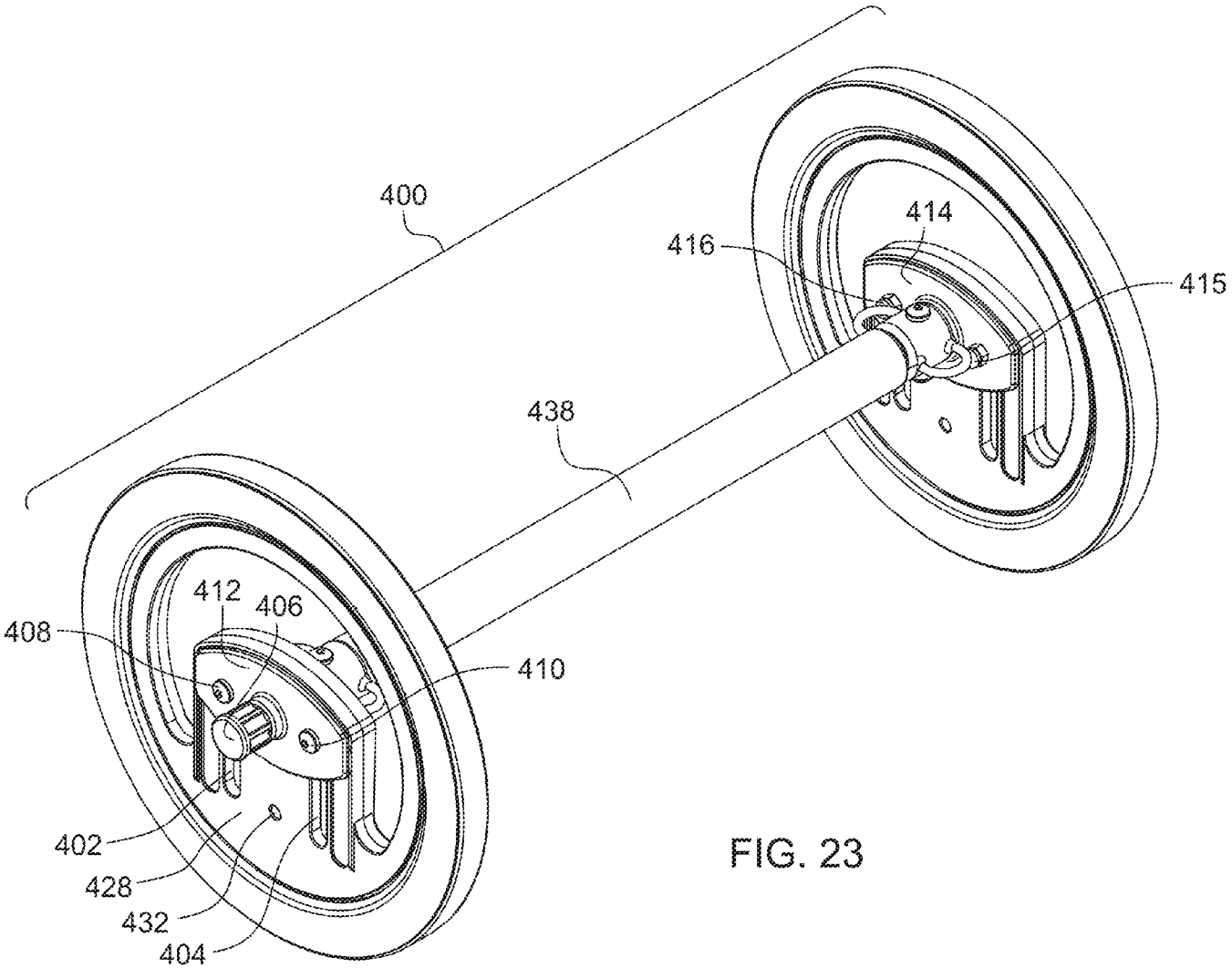
FIG. 23 is a perspective view of an alternate embodiment with cross bar in the up position.
Figure 24:
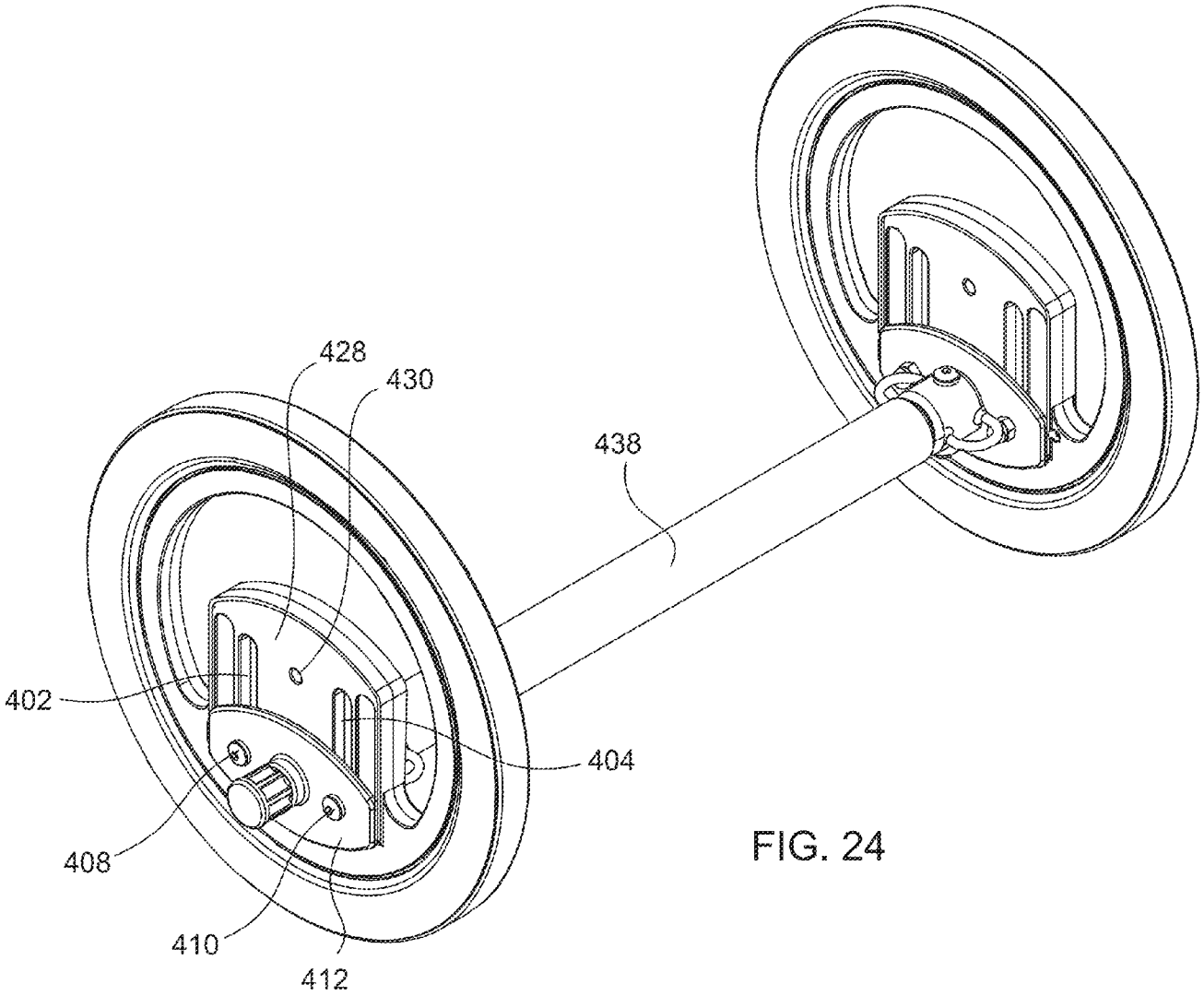
FIG. 24 is a perspective view of an alternate embodiment with cross bar in the low position.
Figure 25:
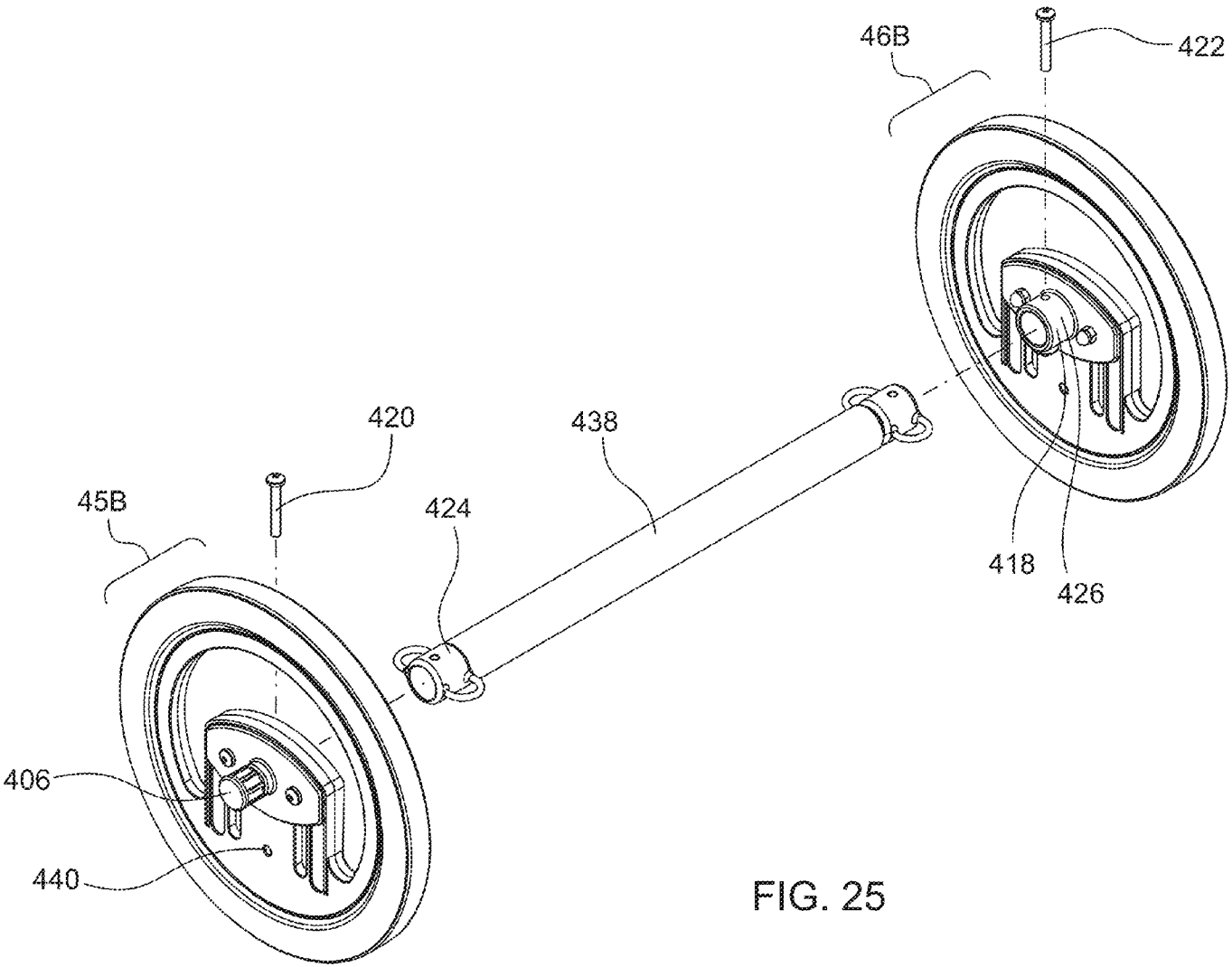
FIG. 25 is an exploded view of the alternate embodiment.

FIG. 3 is an exploded view of the hand/foot plate assembly 8. The lower part of the assembly includes a disk plate 38 attached to a shaft collar 44. The shaft collar 44 includes a cam type tightening member 46 so that the user can slide the assembly 8 to the left or right and then quickly lock it in place via the cam lock 46. The disk plate 38 includes a central threaded post 40 which engages a central aperture 110. Cap nut 44 engages thread 40 to rotatably retain the top hand/foot plate 30 in place. Spring post 42 can engage one of the radial apertures 32 in the hand/foot plate to lock it in at the desired angle with respect to the shaft 6. A standard hook and loop strap 28 is attached to the hand/foot plate in a standard way so that it can retain a person's foot or hand as needed. The strap 28 can be used to hold the top of the foot in certain exercise applications, or can be used as a modified cup shape to hold the heel of the foot in other exercise applications. The curved under portion 48 provides a comfortable grip for the user's fingers when the hand/foot plate assembly is being used for an exercise that requires the hands to be placed on the plate 36. Counterweight 34 helps make the weight of the forward and rear portions of the hand/foot assembly balance out so that the entire hand/foot plate assembly tends to remain in a horizontal position with respect to the ground. This helps the user when sliding his or her foot into the hand/foot assembly. However, it should be noted that the present invention may be used without the foot/hand assembly 8 as shown in FIGS. 23, 24, 25.

Figure 4:
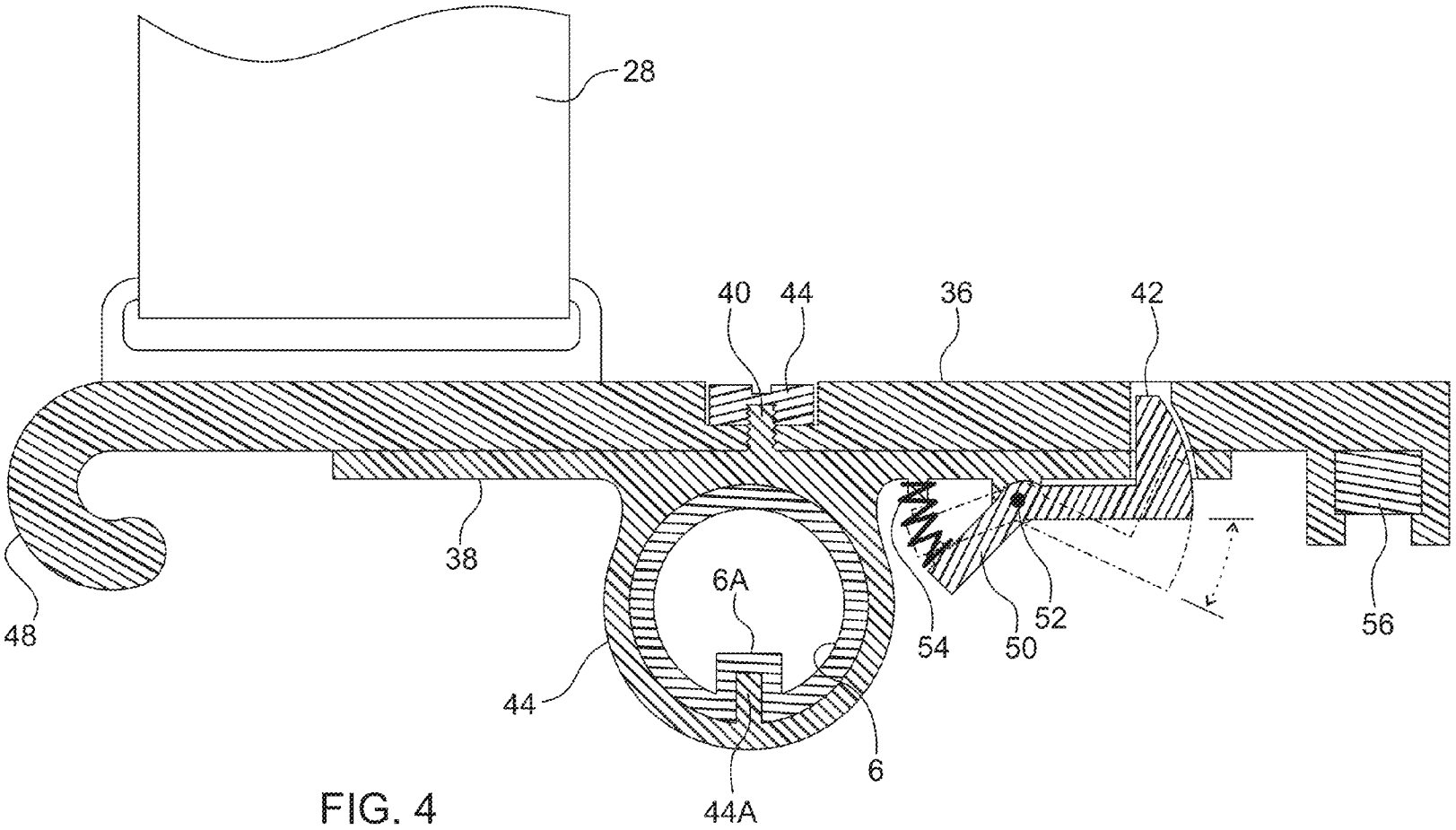
FIG. 4 is a side section view of the hand/foot plate assembly.

FIG. 4 is a side section view of the hand/foot assembly as it is mounted on shaft 6. A groove 6A running the length of shaft 6 can engage a tab 44A on the inner surface of shaft collar 44. This configuration helps keep the two hand/foot plate assemblies 8, 10 in the same plane with respect to the ground. Post 42 is radially held by lever arm 50 which is pinned 52 to the disk plate 38. Spring 54 provides positive bias for the post 42. To change the rotational angle of top plate 36, the user presses on lever arm 50 to disengage post 42, and then rotates the top plate 36 to the desired angle before releasing lever arm 50.

Figure 5:
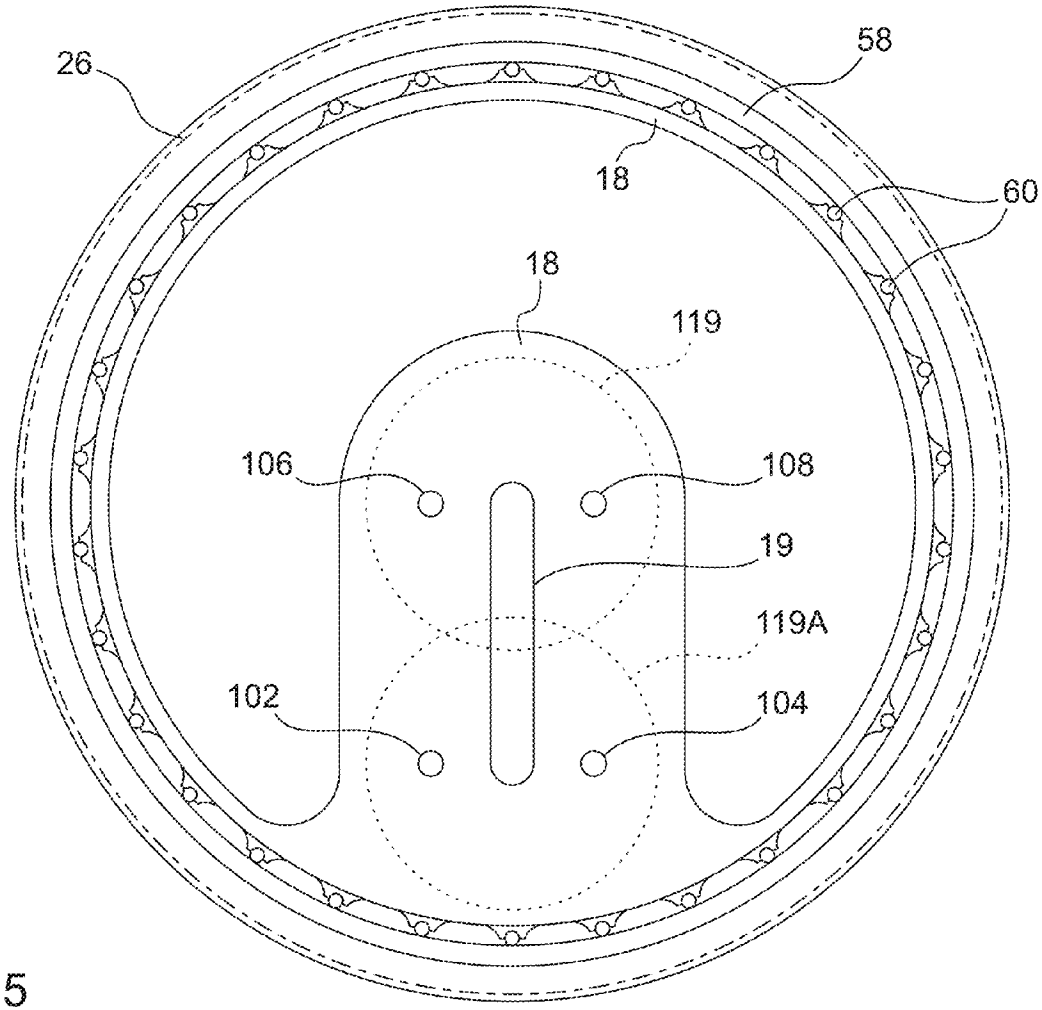
FIG. 5 is a front plan view of the wheel assembly.
Figure 6:
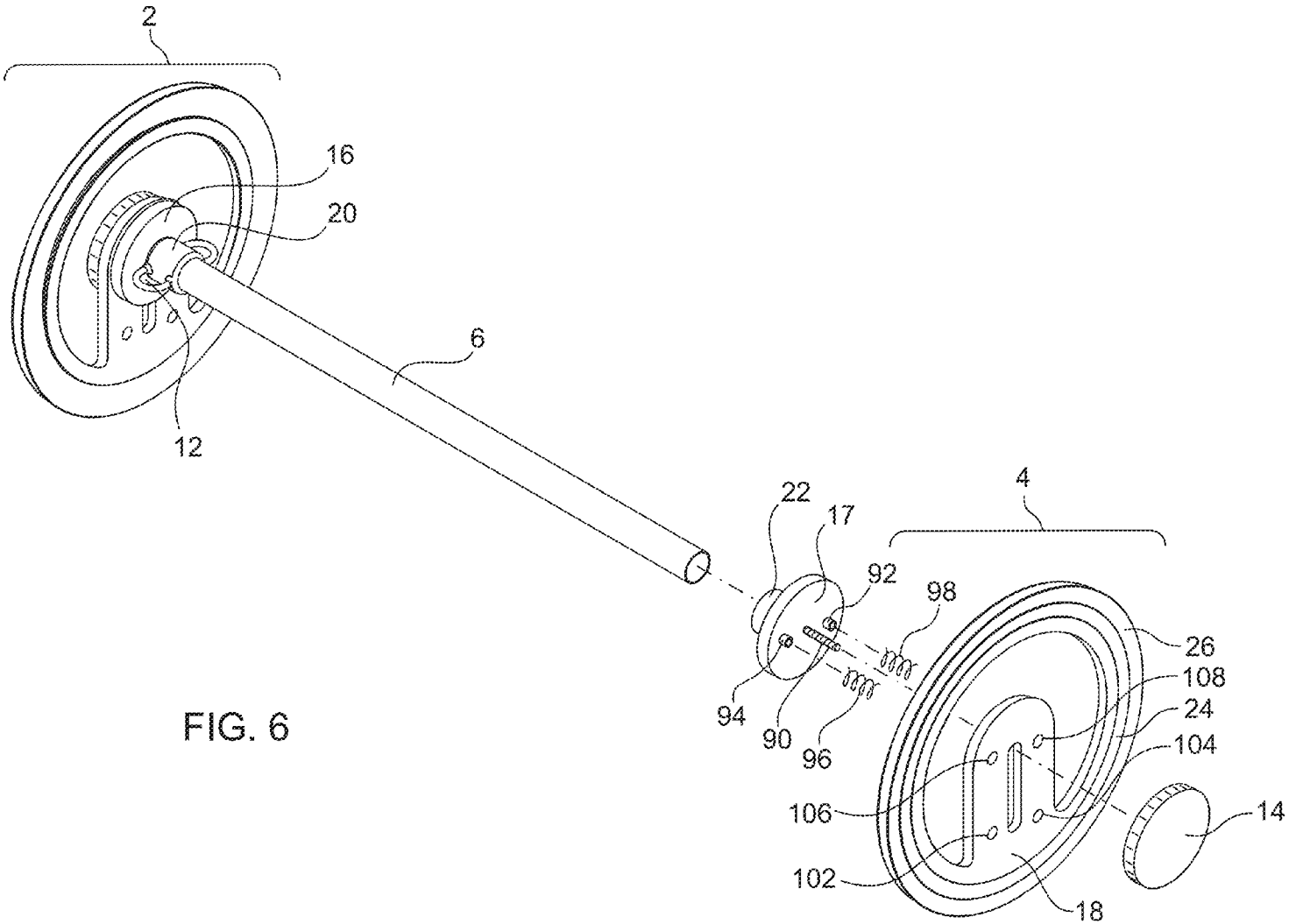
FIG. 6 is an exploded view of the wheel and shaft assembly.

FIG. 5 is a front plan view of the wheel assembly 4. The stationary portion of the wheel 18 includes a center plate with a four inch slot 19 starting from the center of the wheel and ending approximately three inches from the ground plane. Circular dotted line 19 indicates the location of the inner and outer wheel clamping members 14, 17 while the shaft 6 in the upper position. Circular dotted line 19A indicates the location of the inner and outer wheel clamping members 14, 17 when the shaft 6 is in the lower position. The remainder of stationary portion 18 forms the support for an inner race that retains ball bearings 60. An outer race 58 is supported by the opposite side of the ball bearings 58. A rubber tire portion 26 is attached to the outer surface of the outer race 58. Bearing restraining ring plates 23, 24 shown in FIG. 6 capture the bearings 60 so that they remain in contact with the outer perimeter of stationary portion 18 and the inside perimeter of rotating race 58.

FIG. 6 is an exploded view of the wheel and shaft assembly. The hand/foot plates have been removed for clarity purposes. The user can remove wheel assembly 4 by unscrewing outer clamping hub 14. Hub 14 includes a centrally located threaded aperture. The threads match those of protruding shaft threads 90. The user can also partially unscrew hub 14 to allow posts 92, 94 to disengage from holes 106, 108 to allow the shaft 6 to be repositioned to the lower setting 102, 104. Optional springs 96, 98 help the wheel assembly 4 push away from inner clamp member 17 as the hub 14 is being unscrewed thereby causing posts 92, 94 to disengage from holes 106, 108. Resistance band retaining rings 12, 13 are clearly seen mounted to shaft 6 next to hand grips 20, 22. The opposing apertures of the rings 12, 13 allow a total of four resistance bands to be attached, two to ring 12 and two to ring 13, so that bands can be stretched in opposing directions for certain exercises.

Figure 7:
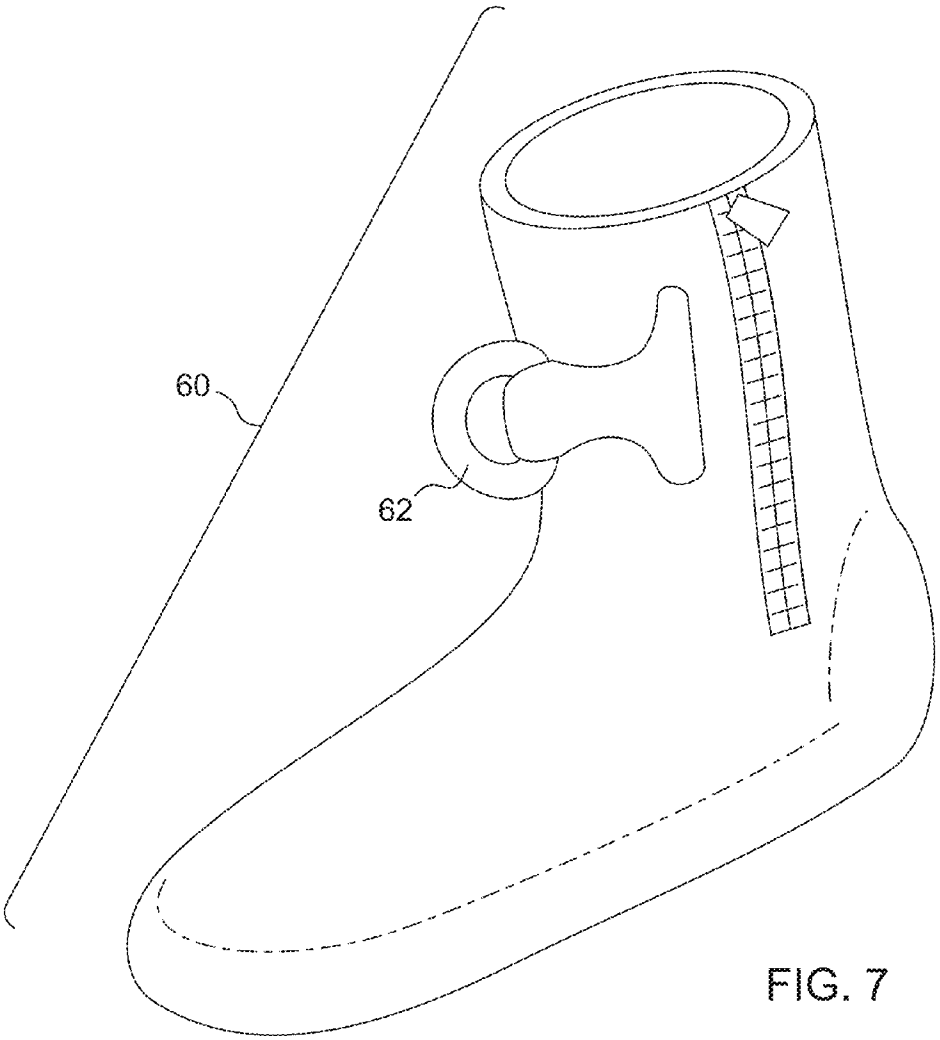
FIG. 7 is a side view of a person using an embodiment with a resistance boot.

FIG. 7 is a side view of a person wearing a specially designed pair of booties 60 that include a resistance band retaining ring 62 firmly attached. Resistance band 64 is made of elastic material such as latex rubber. The band is attached on one side to band retaining ring 12 mounted to shaft 6 and on the other side to ring 62 mounted to bootie 60. As the user 68 stretches out into the plank position, the band 64 provides resistance to arm, leg and abdomen muscles. As the user 68 returns to the kneeling position, the band 64 provides assistance to help return to that position. Alternately, the resistance band may be attached to a person via a standard strap, however there is a danger that the strap may ride up on the leg of the user during certain exercises.

Figure 8:
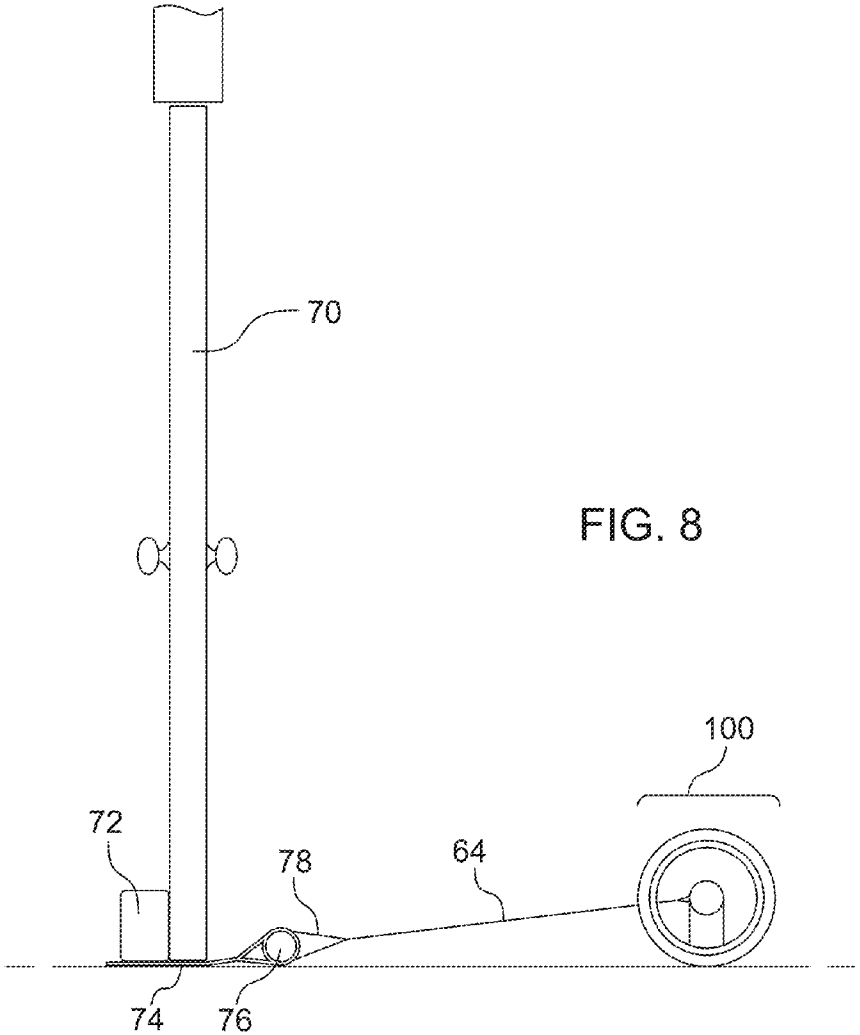
FIG. 8 is a side view of an embodiment in use with a door.
Figure 9:
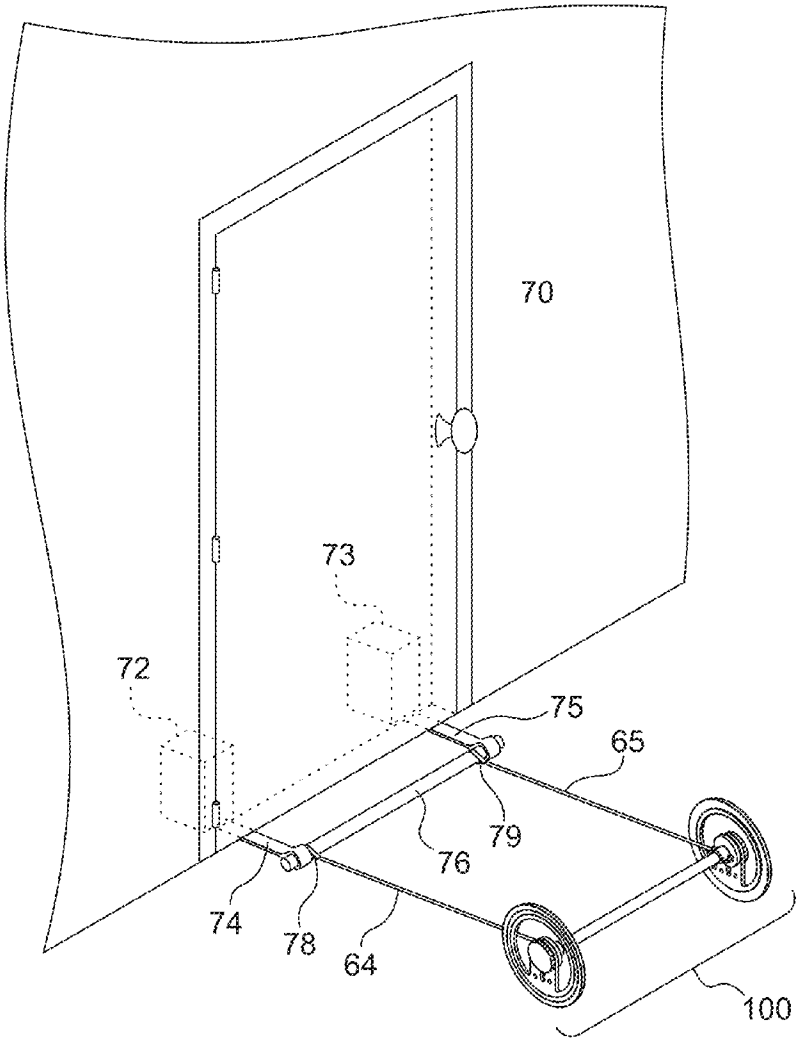
FIG. 9 is a perspective view of an embodiment in use with a door.

FIG. 8 shows a side view of another method of retaining resistance band 64. A strap 74 is attached to padded block 72 on one side of a door 70 and shaft 76 on the opposite side of the door 70. An attachment clip 78 connects the resistance band 64 from the shaft 76 to the shaft 6 of the wheel assembly 100. FIG. 9 shows the same configuration in a perspective view. Padded restraining blocks 72, 73 are shown in dotted line behind door 70. Resistance bands 64, 65 are attached to shaft 76 via rings 78, 79. It should be noted that an additional attachment ring can be located at the center of the shaft 76 for doing additional exercises that require a central resistance band location.

Figure 10:
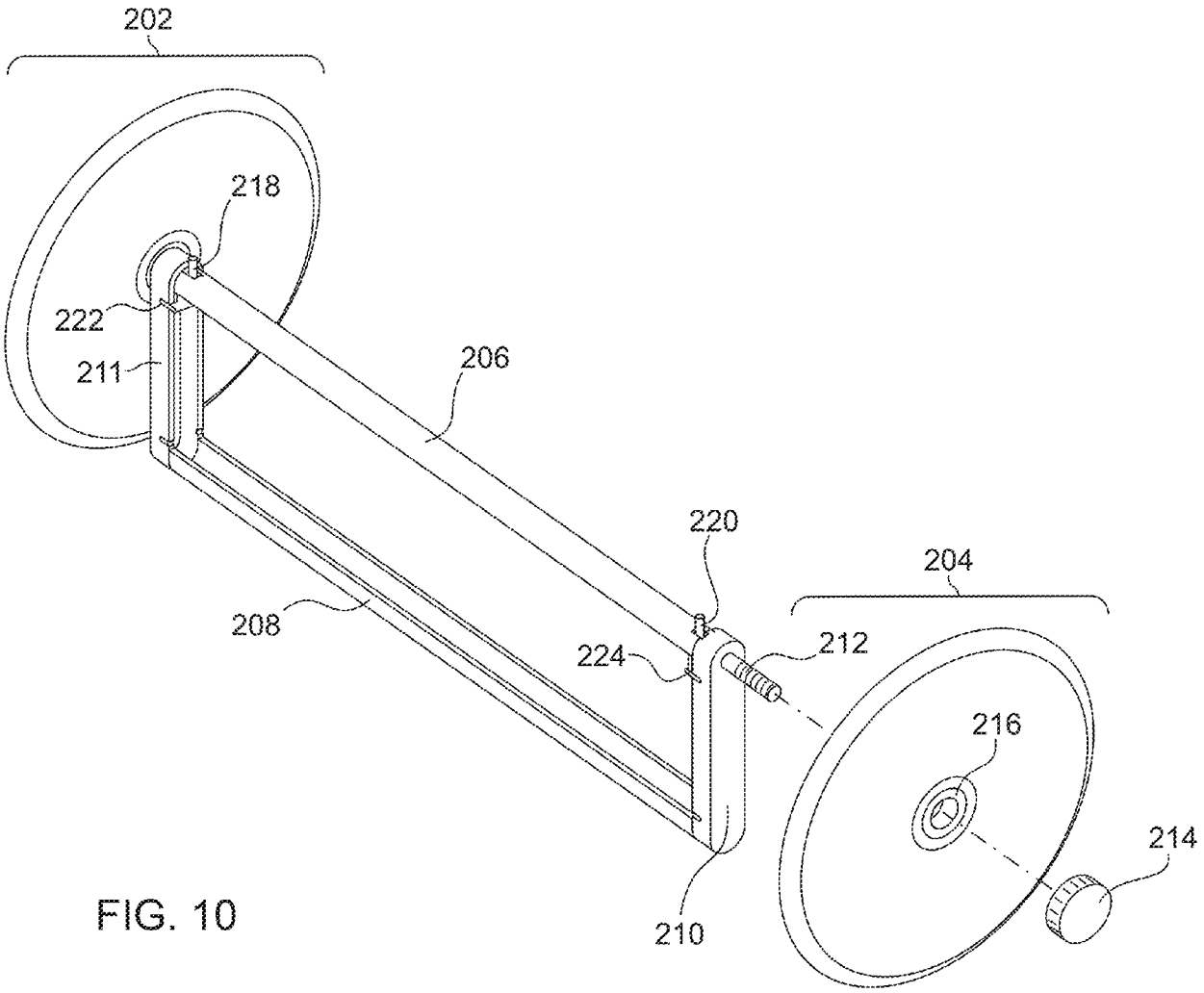
FIG. 10 is a perspective view of an alternate shaft assembly with the shaft in the raised position.
Figure 11:
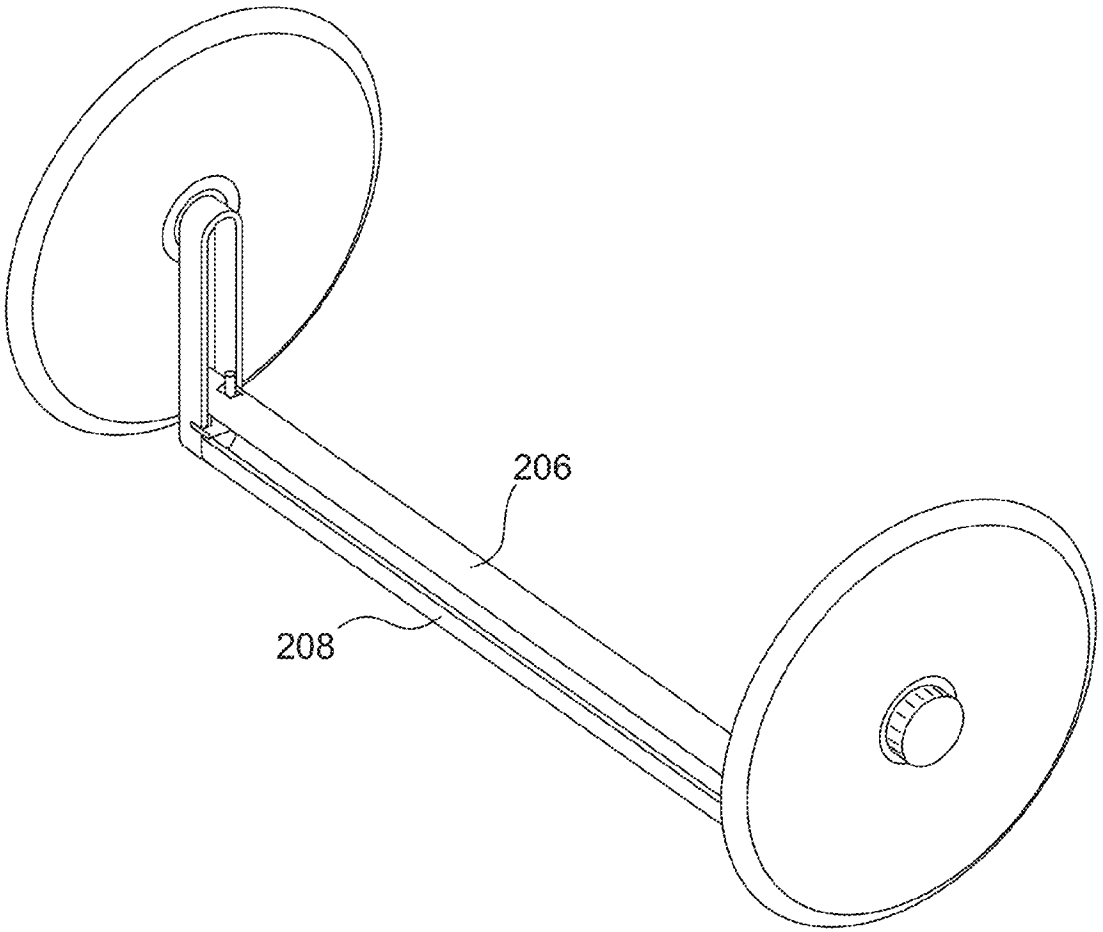
FIG. 11 is a perspective view of the alternate shaft assembly with the shaft in the lowered position.

FIG. 10 shows a perspective view of an alternate embodiment of the high-low shaft assembly. Shaft 206 is slidably retained by side tracks 210, 211. Lower cross brace 208 firmly holds side tracks 210, 211 in position. Outwardly protruding threaded shaft 212 engages central wheel bearing 216. and accepts wheel assembly 204 which is held in place by locking hub 214. A similar mechanism holds wheel 202. Spring biased pins 222, 224 can be disengaged by pulling in on arms 218, 220 allowing the shaft 206 to slide down to the lower position as shown in FIG. 11.

Figure 12:
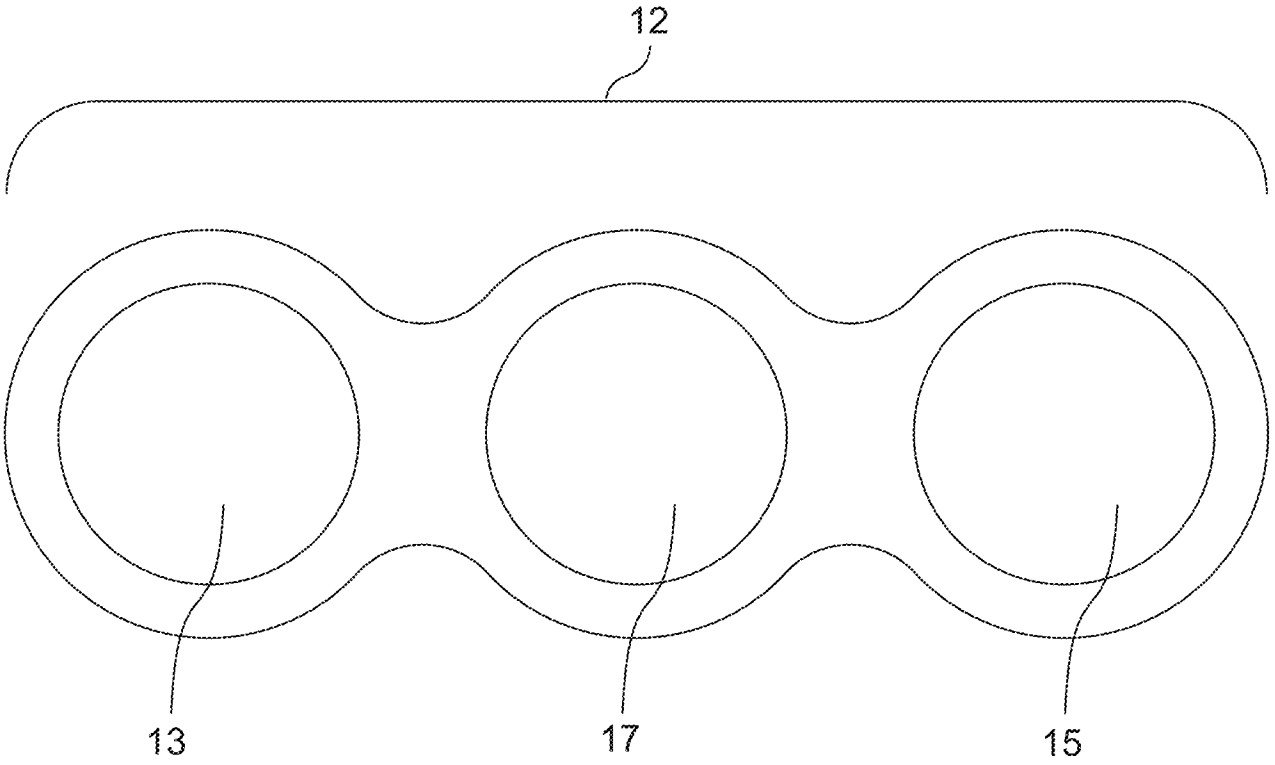
FIG. 12 is a side view of the resistance band retaining member.

FIG. 12 is a front plan view of resistance band retaining ring 12. The central aperture slides over shaft 6. The outer apertures 13, 15 can removably retain a standard Carabiner-type fitting which is in turn attached to a resistance band.

Figure 13:
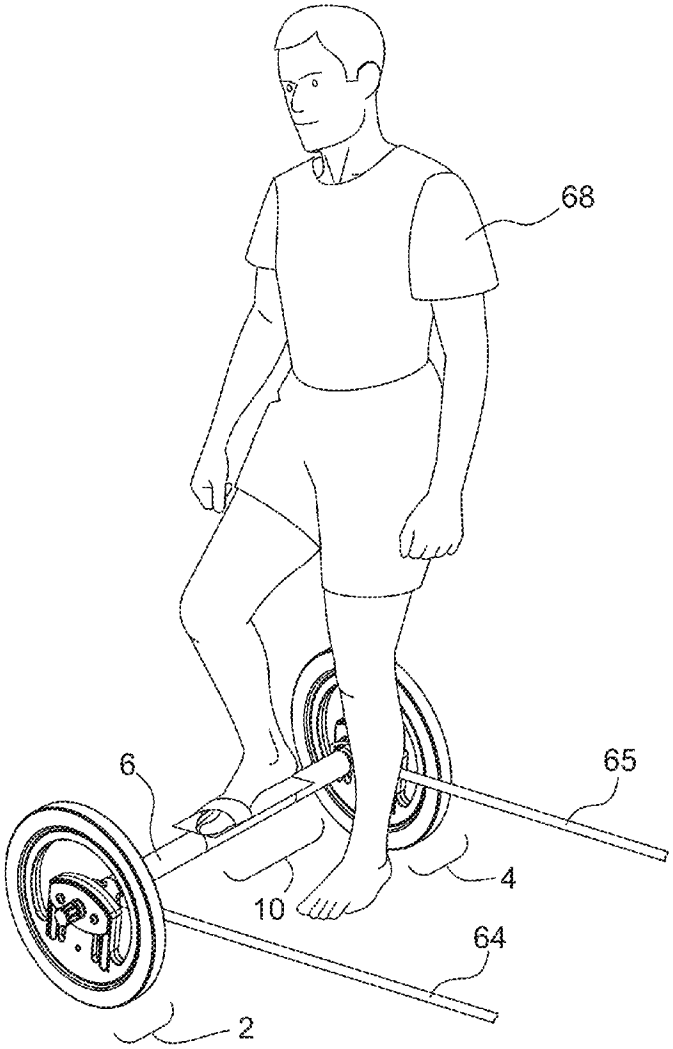
FIG. 13 is a perspective view of a person using the hand/foot plate when it is parallel to the shaft.

FIG. 13 is a perspective view of a person 68 using the apparatus 100 with the hand/foot plate rotated so that it is parallel to the shaft 6, which is helpful when doing slide out leg exercises. As shown, the shaft is in the center or upper position, but as has been described above and is shown in FIG. 24, the shaft may be lowered by the user towards the ground to improve stability and posture while exercising.

Figure 14:
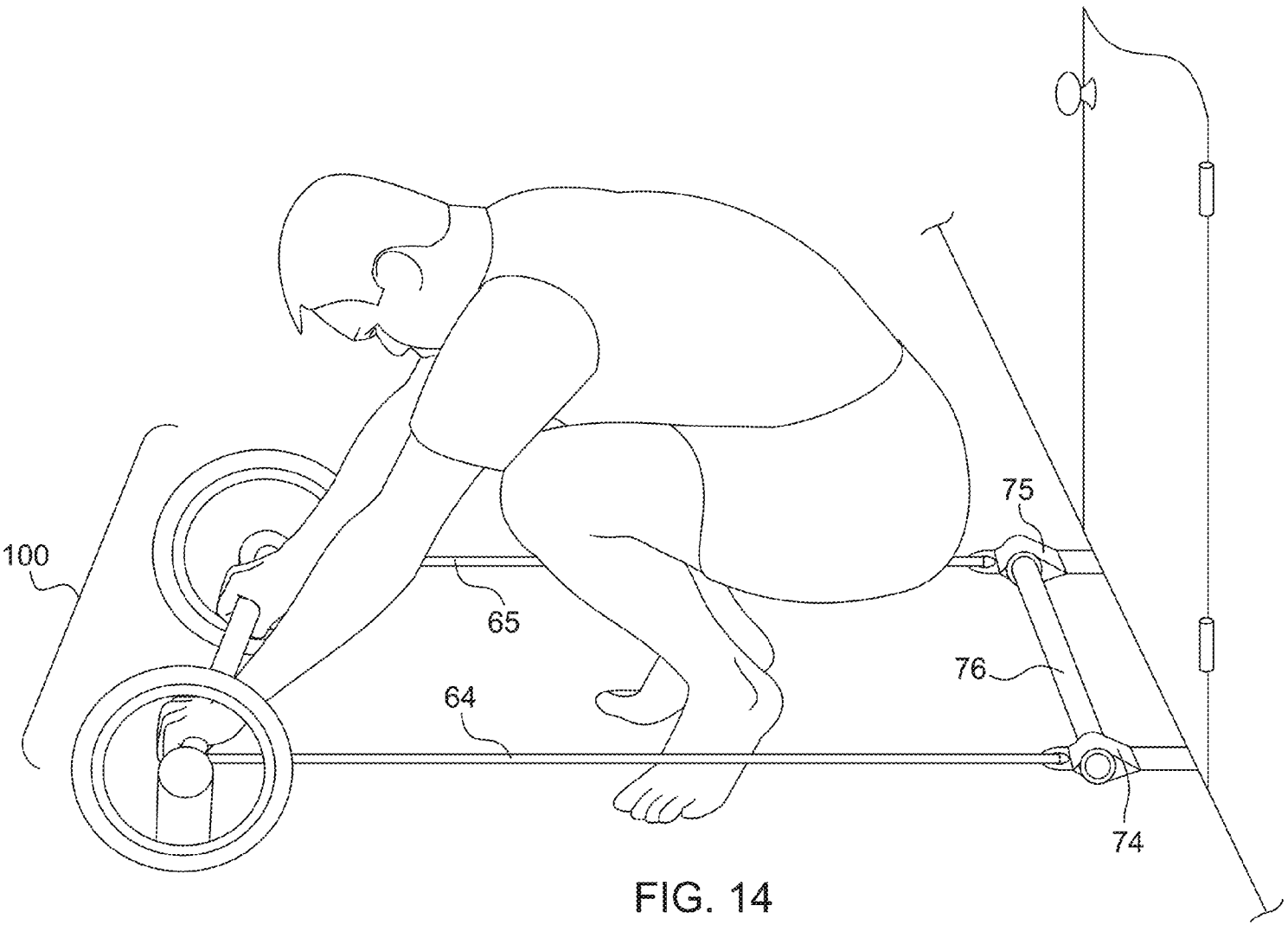
FIG. 14 is a perspective view of a person using an embodiment in a kneeling position.

FIG. 14 is a perspective view of a person 68 getting ready to stretch forward. Resistance bands 64, 65 are positioned with the door restraining assembly described in FIGS. 8 and 9.

Figure 15:
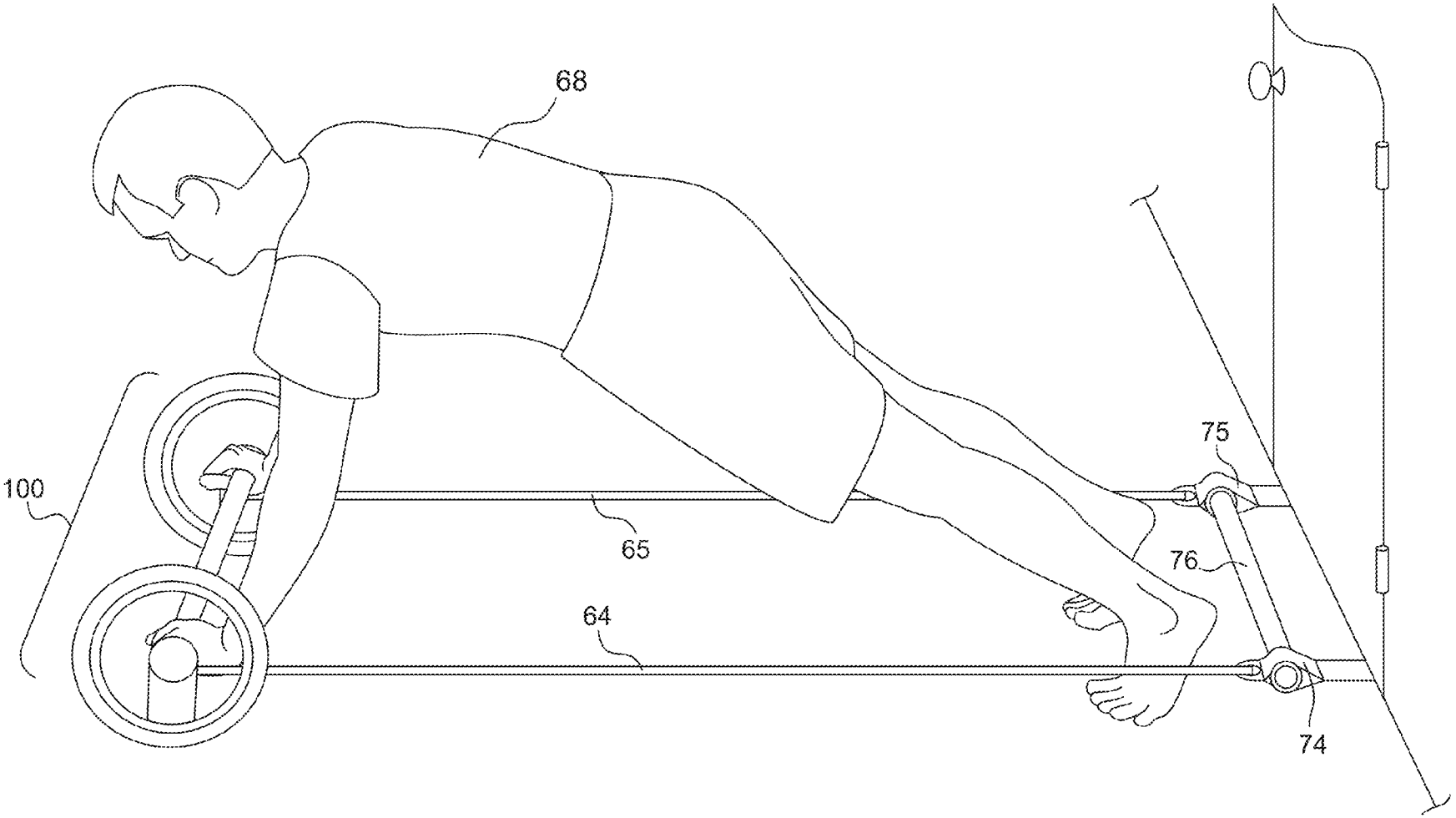
FIG. 15 is a perspective view of a person using an embodiment in a plank position.

FIG. 15 is a perspective view of a person 68 after they have stretched out causing bands 64, 65 to offer resistance on the forward stretch and assistance on the return to the kneeling position.

Figure 16:
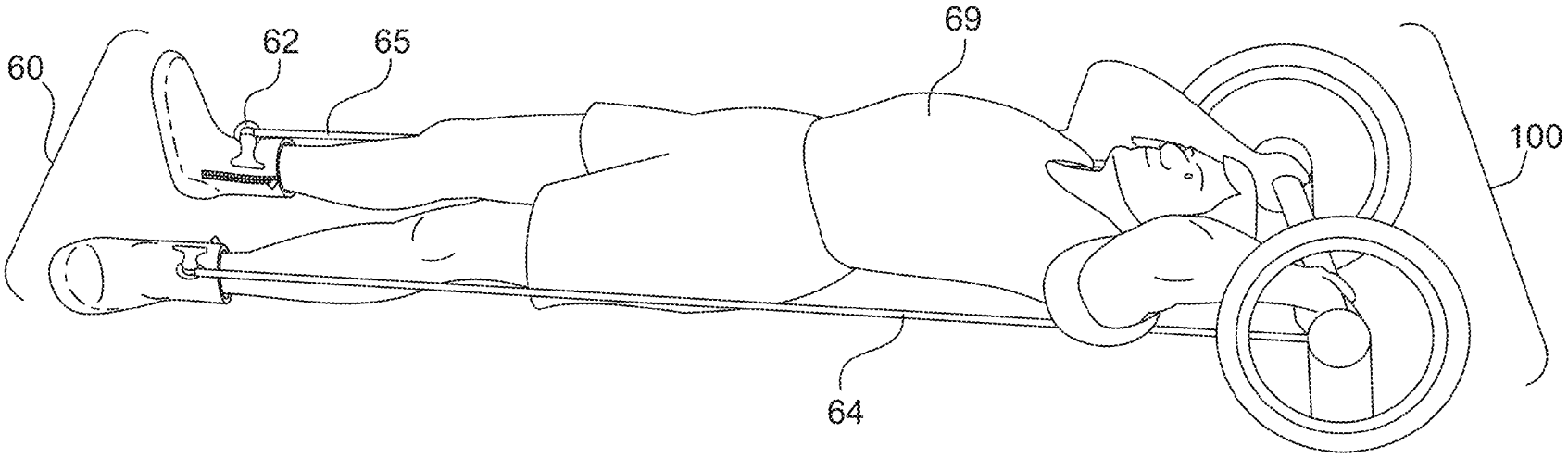
FIG. 16 is a perspective view of a person using an embodiment with arms in a bent position.
Figure 17:
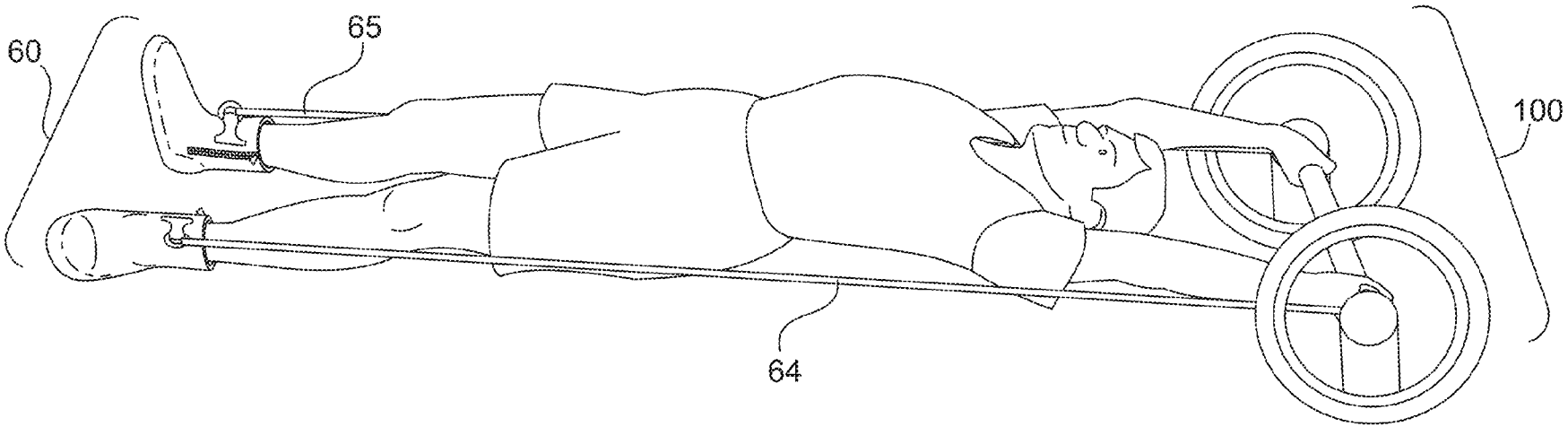
FIG. 17 is a perspective view of a person using an embodiment with arms in a straightened position.

FIGS. 16 and 17 are perspective views of a person 69 using the booties 60 described in FIG. 7 so that as the person 69 extends her arms the resistance bands 64, 65 can work the arm muscles.

Figure 18:
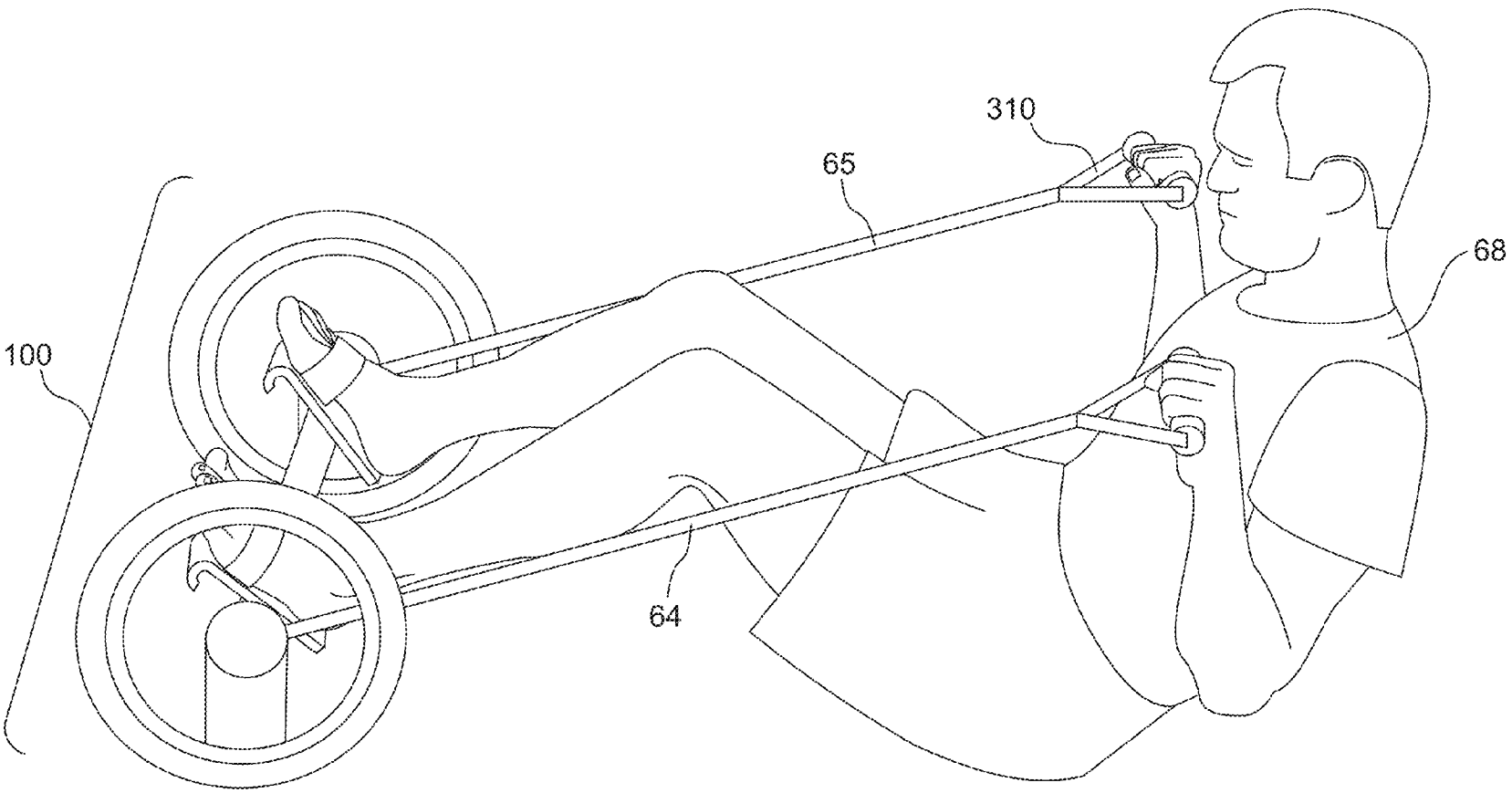
FIG. 18 is a perspective view of a person providing his own resistance by having his feet inserted in the hand/foot plate assemblies and ready to pull on the resistance bands.
Figure 19:
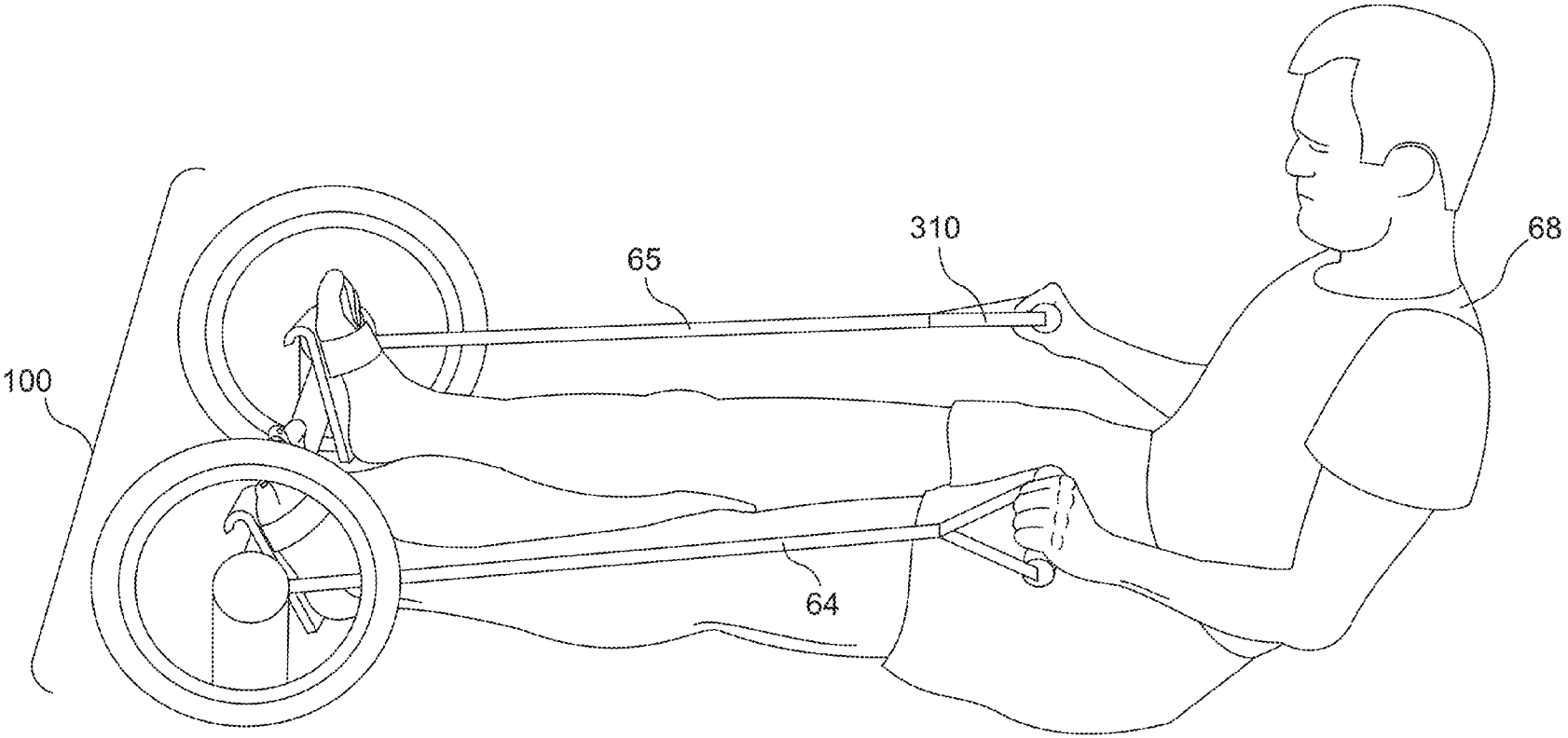
FIG. 19 is a perspective view of a person providing his own resistance with resistance bands in the pulled position.

FIGS. 18 and 19 are perspective views of a person 68 using the resistance bands 64, 65 of the apparatus 100 to exercise leg muscles by rolling the wheels 2, 4 forward and backward.

Figure 20:
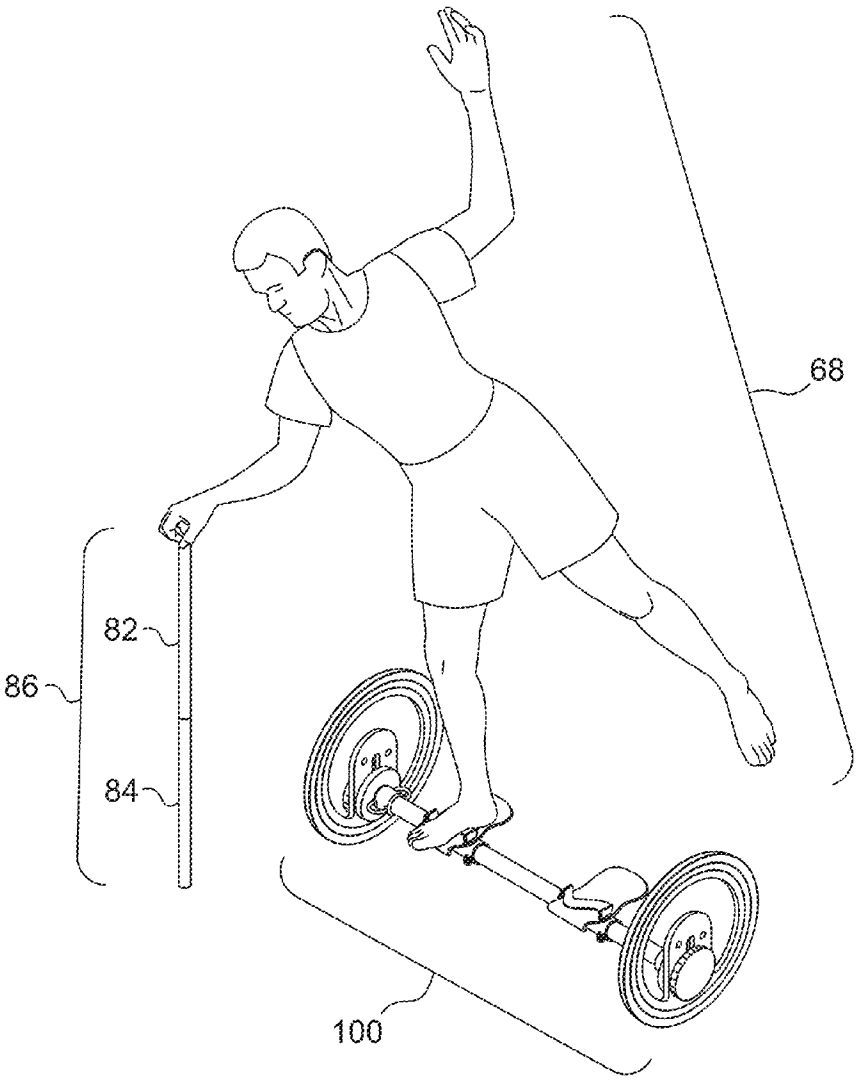
FIG. 20 is a perspective view of a person using a support staff.

FIG. 20 shows the user 68 employing a support staff 86 to help support the user 68 while doing an exercise by a forward and backward rolling of the apparatus 100. The support staff 86 is made of two sections 82, 84 that are screwed, or otherwise held together. The two halves 82, 84 can be unscrewed for compact storage.

Figure 21:
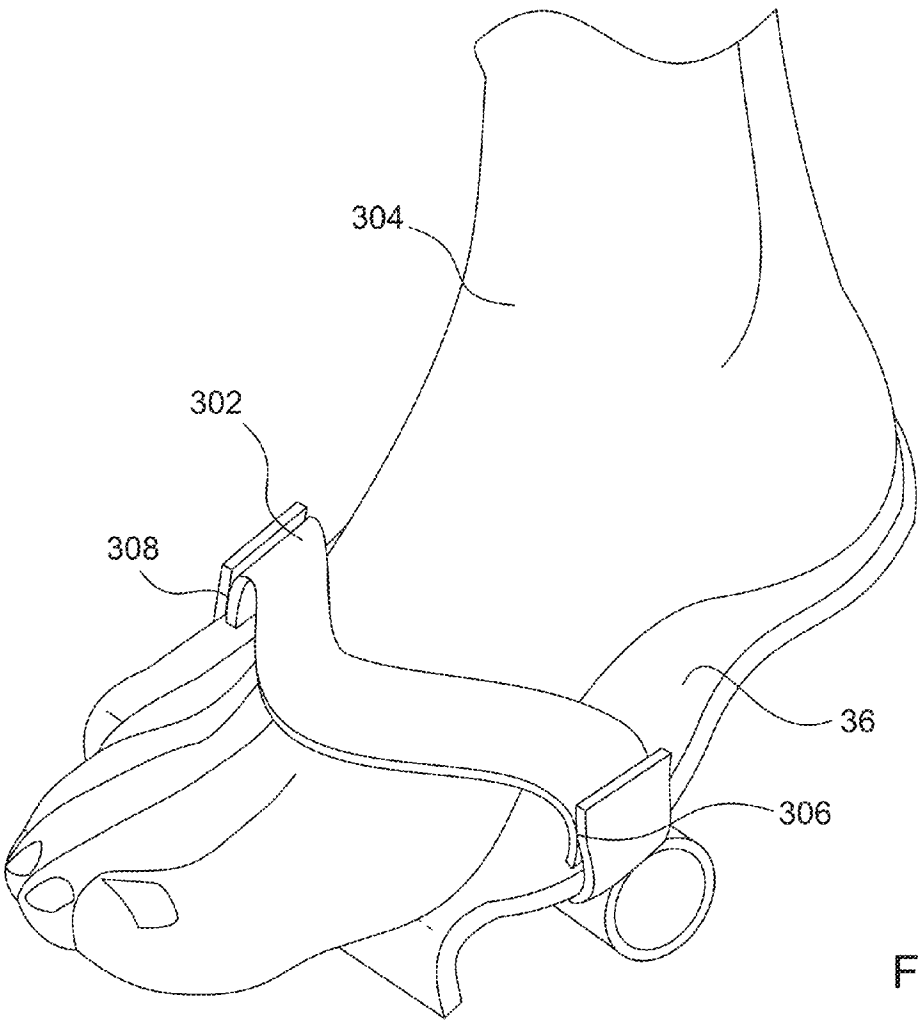
FIG. 21 is a partial perspective view of a person's foot while retained under an alternate foot holding strap.

FIG. 21 is a partial perspective view of a person's leg and foot 304 being held on platform 36 by alternate design strap 302. In this use, the foot 304 is retained under the strap 302. Standard hook and loop fasteners hold each end 306, 308 of the strap 302 together so that the user can adjust the length of the strap 302.

Figure 22:
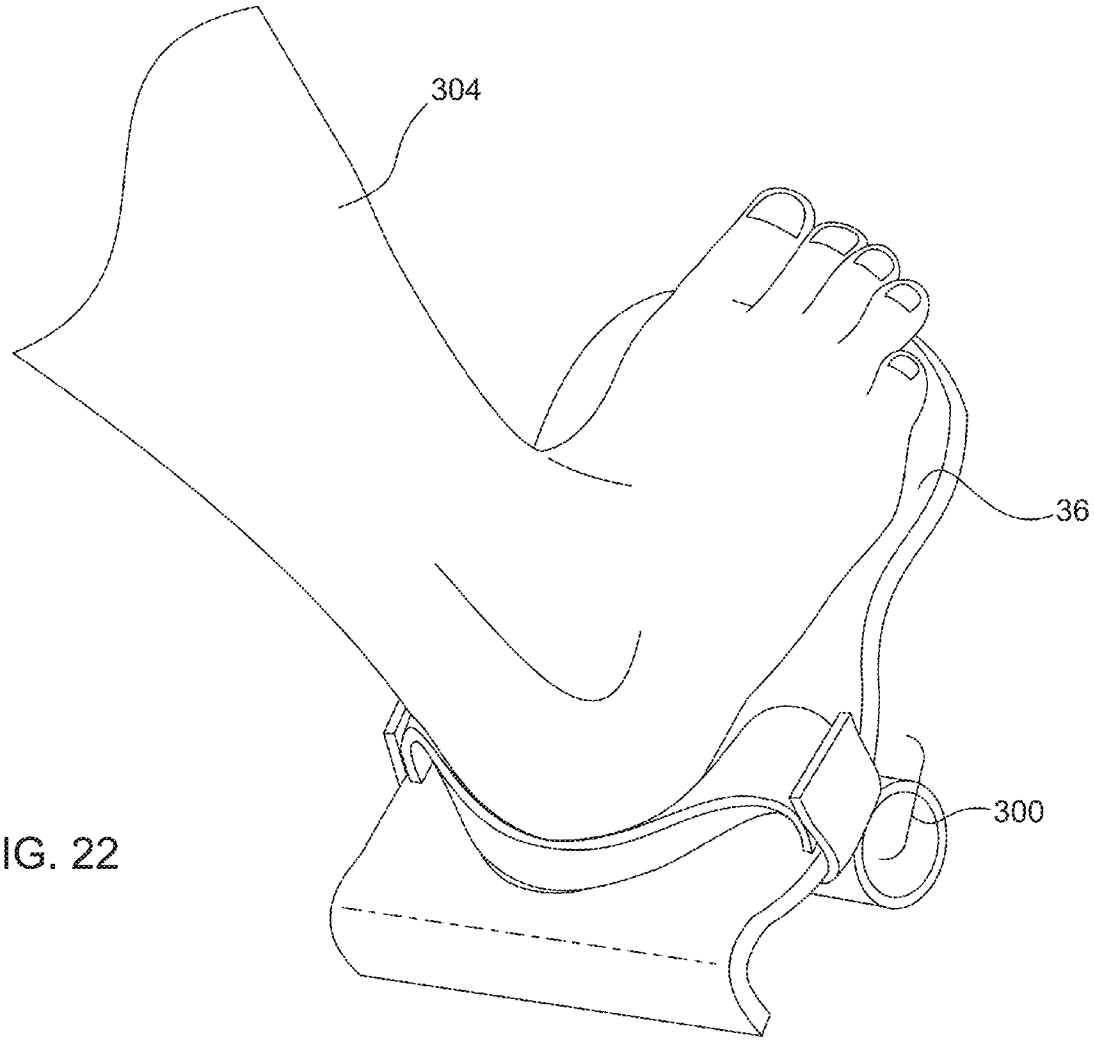
FIG. 22 is a partial perspective view of a person's foot while the heel is retained by the alternate foot holding strap.

FIG. 22 is a partial perspective view of a person's leg 304 where the heel is cradled in strap 300 which is desirable in performing certain exercises.

The present invention can be used in different positions and configurations in conjunction with resistance bands to work every muscle in the body. A support pole or poles can be used by a person to help stabilize them while they are inserting their feet into the hand/foot plate assembly straps. Obviously, a version of the invention can be envisioned where the shaft is stationary at the center point of the wheel and cannot be adjusted to a lower position. Additionally, there are other standard ways to attach the wheels to the shaft. Also, the wheels may be a larger or smaller diameter than the ones described above. Finally, because the wheel assemblies can be easily removed and replaced, the entire invention can be stored in a relatively small container for storage or shipment.

FIG. 23 is a perspective view of an alternate embodiment of the invention 400. In this embodiment, a central wheel portion 428 is trapped between an outer plate 412 and an inner plate 414. This present description assumes that inner and outer plates 412, 414 are identical in design for both wheels. A spring plunger post assembly 406 includes a post that engages a hole, 430 shown in FIG. 24. The plunger post 406 keeps the cross shaft 438 in an upper, centrally located position. When a user wishes to change the bar 438 to the lower position, he or she pulls on plunger knob 406 which disengages the plunger post from hole 430, allowing the inner and outer plates 412, 414 to slide down to the lower position as shown in FIG. 24 where post plunger 406 engages hole 440 as shown in FIG. 25. Slots 402, 404 engage with bolts 408, 410 and nuts 415, 416 to help keep the inner and outer plates 412, 414 in proper orientation with respect to central wheel portion 428. When the user wishes to raise the bar 438 back to the upper position, he or she pulls on plunger knob 406 and lifts slide plates 412, 414 and attached cross bar 438 back to the up position.

FIG. 25 is an exploded view of the alternate embodiment 400 of the present invention. To remove the wheels 450, 460 from the cross bar 438, the user pulls retaining pins 420, 422 from apertures 424, 418. This allows cross shaft collar 426 and its counterpart on wheel 450 to be released from shaft 438.

As may be seen from the drawings of various embodiments, the dimensions of the apparatus, including the sizes of the inner and outer wheel assembly structures, the shaft length and diameter, and the shaft end structures encompass a large range so as to be suitable for portability and the dimensions of a person using the apparatus.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A portable exercise device comprising a pair of wheel assemblies, wherein each wheel assembly comprises an outer ring, an inner ring, a bearing structure connecting the outer and inner rings wherein the bearing structure allows for rotation between the inner and outer rings, a mounting structure affixed to the inner ring which extends radially inward within the inner ring;

a shaft wherein the shaft is configured to be selectably affixed by a user to each of the pair of wheel assembly mounting structures at a location selected from at least one radial location on a diameter line of each respective inner ring extending inward from a circumference of each respective inner ring;

whereby the device is configured as a stable, weight-bearing rolling structure with the shaft oriented between the pair of wheel assemblies, such that the shaft is configured to be adjustably positioned by the user at selected radial positions between a center of each respective wheel assembly and an outer circumference of each respective wheel assembly.

2. The device as in claim 1 wherein each mounting structure comprises two parallel linear slots offset from and parallel to the diameter line of each respective inner ring, and wherein the shaft also comprises end guiding structures which are positioned within the respective two parallel linear slots;

whereby the respective two parallel linear slots and the respective end guiding structures provide wheel rotation stability.

3. The device as in claim 1 wherein opposing ends of the shaft are configured to be selectably and respectively affixed by the user to each of the pair of wheel assembly mounting structures at the location selected from the respective at least one radial locations, whereby the shaft ends are configured to be adjustably and respectively positioned by the user at the selected radial positions, wherein the selected radial positions of the respective shaft ends may be changed while the respective shaft ends remain connected to each of the pair of wheel assemblies.

4. The device as in claim 1 also comprising:

one or plural pairs of resistance bands connectable to the shaft.

5. The device as in claim 4 wherein the one or plural pairs of resistance bands comprise pairs of resistance bands of different lengths.

6. The device as in claim 4 wherein the one or plural pairs of resistance bands comprise pairs of resistance bands of different elasticities.

7. The device as in claim 4 wherein the one or plural pairs of resistance bands also comprise end structures which may be affixed to substantially fixed furniture or building interior items.

8. A method for performing exercises with a portable exercise device comprising:

rolling the portable exercise device, wherein the portable exercise device comprises: a pair of wheel assemblies, wherein each wheel assembly comprises an outer ring, an inner ring, a bearing structure connecting the outer and inner rings wherein the bearing structure allows for rotation between the inner and outer rings, a mounting structure affixed to the inner ring which extends radially inward within the inner ring; a shaft, wherein the shaft is configured to be selectably affixed by a user to each of the pair of wheel assembly mounting structures at a location selected from at least one radial location on a diameter line of each respective inner ring extending inward from a circumference of each respective inner ring;

whereby the exercises are performed by rolling the portable exercise device, whereby the portable exercise device is configured as a stable, weight-bearing rolling structure with the shaft oriented between the pair of wheel assemblies, such that the shaft is configured to be adjustably positioned by the user at selected radial positions between a center of each respective wheel assembly and an outer circumference of each respective wheel assembly.

9. The method as in claim 8 wherein each mounting structure comprises two parallel linear slots offset from and parallel to the diameter line of each respective inner ring, and wherein the shaft also comprises end guiding structures which are positioned within the slot structures;

whereby the respective two parallel linear slots and the respective end guiding structures provide wheel rotation stability.

10. The method as in claim 8 wherein opposing ends of the shaft are configured to be selectably and respectively affixed by the user to each of the pair of wheel assembly mounting structures at the location selected from the respective at least one radial locations, whereby the shaft ends are configured to be adjustably and respectively positioned by the user at the selected radial positions, wherein the selected radial positions of the respective shaft ends may be changed while the respective shaft ends remain connected to each of the pair of wheel assemblies.

11. The method as in claim 8 wherein the portable exercise device also comprises one or plural pairs of resistance bands connectable to the shaft.

12. The method as in claim 11 wherein the one or plural pairs of resistance bands comprise pairs of resistance bands of different lengths.

13. The method as in claim 11 the one or plural pairs of resistance bands comprise pairs of resistance bands of different elasticities.

* * * * *